US010477292B2

(12) United States Patent
Ivey

(10) Patent No.: US 10,477,292 B2
(45) **Date of Patent: *Nov. 12, 2019**

(54) PLASTIC ACOUSTIC ENCLOSURE

(71) Applicant: Mitek Corp., Inc., Phoenix, AZ (US)

(72) Inventor: Johnathan Ivey, Chandler, AZ (US)

( * ) Notice: Subject to any disclaimer, the term of this patent is extended or adjusted under 35 U.S.C. 154(b) by 33 days.

This patent is subject to a terminal disclaimer.

(21) Appl. No.: 15/337,950

(22) Filed: Oct. 28, 2016

(65) Prior Publication Data

US 2018/0124485 A1 May 3, 2018

(51) Int. Cl.
*H04R 1/02* (2006.01)
*H04R 1/28* (2006.01)

(52) U.S. Cl.
CPC ..... *H04R 1/026* (2013.01); *H04R 1/288* (2013.01); *H04R 2201/028* (2013.01)

(58) Field of Classification Search
CPC ... H04R 1/026; H04R 1/288; H04R 2201/028
USPC ..... 381/332
See application file for complete search history.

(56) References Cited

U.S. PATENT DOCUMENTS 3,366,748 A * 1/1968 Ashworth ..... H04R 17/00 181/144
3,848,696 A * 11/1974 Everitt ..... H04R 1/021 181/156
4,122,911 A 10/1978 Croup
4,146,745 A 3/1979 Froeschle et al.
4,227,051 A * 10/1980 Thomas ..... H04R 1/24 181/144
4,319,098 A * 3/1982 Baitcher ..... H04R 7/20 181/166
5,661,271 A 8/1997 Moser
5,704,578 A * 1/1998 Fischer ..... F16C 11/106 248/221.11
5,828,766 A * 10/1998 Gallo ..... H04R 17/00 381/190
9,084,047 B2 7/2015 O'Polka
2004/0125974 A1* 7/2004 Kosatos ..... H04R 1/025 381/335
2005/0018868 A1 1/2005 Chick et al.
(Continued)

FOREIGN PATENT DOCUMENTS

GB 2540793 * 2/2017 ..... B32B 5/18

*Primary Examiner* — Quynh H Nguyen
(74) *Attorney, Agent, or Firm* — Keith L. Jenkins, Registered Patent Attorney, LLC; Keith L. Jenkins

(57) ABSTRACT

A corrugated plastic sheet with fold lines, as centerlines of V-shaped grooves, that can be folded by hand into a plastic acoustic enclosure, with or without additional corrugated plastic panels. A speaker opening is provided in the sheet, and a speaker support fixture, ring, or panel may assist in supporting the speaker on the enclosure. Foldable flanges and foldable narrow panels with adhesive strips, preferably with release layers, enable assembly of the enclosure without tools, other than for speaker installation. An amplifier attached to a panel of the enclosure, preferably on an external surface, is presented. An enclosure that supports more than one speaker is presented. The plastic acoustic enclosure that can be shipped flat and unassembled and then assembled by a user. The enclosure is lightweight, and so ships economically and does not significantly burden automobiles in which such enclosures may be installed.

19 Claims, 23 Drawing Sheets

(56) References Cited

U.S. PATENT DOCUMENTS

| | | | | |
|---|---|---|---|---|
| 2006/0165248 | A1* | 7/2006 | Butcher | H04R 1/021<br>381/345 |
| 2008/0000714 | A1* | 1/2008 | Adams | H04R 1/025<br>181/148 |

* cited by examiner

2900

PLASTIC ACOUSTIC ENCLOSURE

FIELD OF ART

The present invention relates to lightweight enclosures for loudspeakers. The present invention more particularly relates to corrugated plastic loudspeaker enclosures which may be shipped in a flat configuration and folded to final shape by a recipient. Alternatively, they may be sold assembled with speakers attached.

BACKGROUND OF THE INVENTION

Loudspeaker enclosures are traditionally made of wood, which is heavy. Accordingly, a lightweight speaker enclosure is desired.

SUMMARY OF THE INVENTION

Briefly described, the invention includes foldable self-adhesive corrugated loudspeaker enclosures that can be shipped flat and assembled, without tools, into lightweight durable speaker enclosures. In an embodiment, a plastic acoustic enclosure, including: a sheet of corrugated plastic; a plurality of fold lines in the sheet of corrugated plastic; and: a speaker opening in the sheet of corrugated plastic and/or a speaker support opening in the sheet of corrugated plastic. That plastic acoustic enclosure, including an additional panel of corrugated plastic adapted to become part of the plastic acoustic enclosure upon assembly. That plastic acoustic enclosure, where a fold line of the plurality of fold lines is a centerline of a V-shaped groove in the additional panel of corrugated plastic. That plastic acoustic enclosure, including an audio amplifier attached to either the sheet of corrugated plastic or a panel of the additional panel of corrugated plastic. That plastic acoustic enclosure, including a adhesive foldable flange extending from the additional panel of corrugated plastic. That plastic acoustic enclosure, including an adhesive strip adapted to secure the sheet of corrugated plastic in a folded configuration. That plastic acoustic enclosure, where each fold line of the plurality of fold lines includes a centerline of a V-shaped groove in the sheet of corrugated plastic. That plastic acoustic enclosure, including acoustic dampening material applied to: the V-shaped groove; a portion of the sheet of corrugated plastic; and/or a channel in the sheet of corrugated plastic. That plastic acoustic enclosure, including a speaker support adapted to assist in supporting a speaker at least partially within the plastic acoustic enclosure. That plastic acoustic enclosure, including a rim on the speaker support, where at least a portion of the rim is configured to rest on an environmental surface when the plastic acoustic enclosure is assembled and placed in an operational orientation. That plastic acoustic enclosure, including adhesive strips adapted to adhere the speaker support to the sheet of corrugated plastic. That plastic acoustic enclosure, including two corrugated plastic side panels and a speaker support. That plastic acoustic enclosure, including: a corrugated plastic interior support and a speaker support ring. That plastic acoustic enclosure, including: top and bottom panels, each the panel having three adhesive foldable flanges, each adhesive foldable flange of the three adhesive foldable flanges extending from one of three edges of the panel, respectively, and a speaker support ring. That plastic acoustic enclosure, including: a corrugated plastic shaped sheet configurable to form a tweeter horn and a speaker support panel having a counter sunk annular flange.

In an embodiment, plastic acoustic enclosure, including: a sheet of corrugated plastic; a plurality of fold lines in the sheet of corrugated plastic; a speaker opening in the sheet of corrugated plastic, and/or a speaker support opening in the sheet of corrugated plastic; an additional panel of corrugated plastic adapted to become part of the plastic acoustic enclosure upon assembly; and where a fold line of the plurality of fold lines includes a centerline of a V-shaped groove in the additional panel of corrugated plastic; where each fold line of the plurality of fold lines includes a centerline of a V-shaped groove in the sheet of corrugated plastic; an adhesive strip adapted to secure the sheet of corrugated plastic in a folded configuration; and an adhesive foldable flange extending from the additional panel of corrugated plastic. That plastic acoustic enclosure, including: a speaker support adapted to assist in supporting a speaker at least partially within the plastic acoustic enclosure; a rim on the a speaker support, where at least a portion of the rim is configured to rest on an environmental surface when the plastic acoustic enclosure is assembled and placed in an operational orientation; and a plurality of adhesive strips adapted to adhere the speaker support to the sheet of corrugated plastic. That plastic acoustic enclosure, including acoustic dampening material applied to the V-shaped groove; a portion of the sheet of corrugated plastic; and/or a channel in the sheet of corrugated plastic. That plastic acoustic enclosure, including an audio amplifier attached to the sheet of corrugated plastic, and/or a panel of the additional panel of corrugated plastic.

In an embodiment, a plastic acoustic enclosure, including: a sheet of corrugated plastic; a plurality of fold lines in the sheet of corrugated plastic; a speaker opening in the sheet of corrugated plastic; and a speaker support opening in the sheet of corrugated plastic; further including: a corrugated plastic side panel adapted to form a part of the plastic acoustic enclosure, when assembled; a speaker support ring adapted to form a part of the plastic acoustic enclosure, when assembled; a speaker support panel adapted to form a part of the plastic acoustic enclosure, when assembled; a speaker support fixture adapted to form a part of the plastic acoustic enclosure, when assembled; a corrugated plastic interior support adapted to form a part of the plastic acoustic enclosure, when assembled; top and bottom panels of the sheet of corrugated plastic, each panel having three adhesive foldable flanges, each adhesive foldable flange of the three adhesive foldable flanges extending from one of three edges of the panel, respectively; an audio amplifier attached to one of; a corrugated plastic panel of the a corrugated plastic side panel; and the corrugated plastic sheet; and acoustic dampening material applied to: the V-shaped groove; a portion of the sheet of corrugated plastic; and a channel in the sheet of corrugated plastic; and attachment features on said sheet of corrugated plastic, comprising at least one of: channels; adhesive strips; adhesive strips with release layers; channels with adhesive strips; channels with adhesive strips with release layers; adhesive sound deadening materials; adhesive sound deadening materials with release layers; channels with adhesive sound deadening materials; and channels with adhesive sound deadening materials with release layers.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

As used and defined herein, "left" and "right", "top" and "bottom" are referenced to a viewer's left and right as the viewer looks at the side of the cabinet on which the speaker is mounted and facing. As used and defined herein, "top" and "bottom" are referenced to the cabinet in its normal operational orientation, which may be the top and bottom of the page, or on a side of the page indicating a portion which will be at the top or bottom, respectively, when the cabinet is assembled and placed in its operational orientation. As used and defined herein "fold lines" and "folding lines" mean the same thing. As used and defined herein, "speaker" means an acoustic driver, or loudspeaker.

Figure 1:
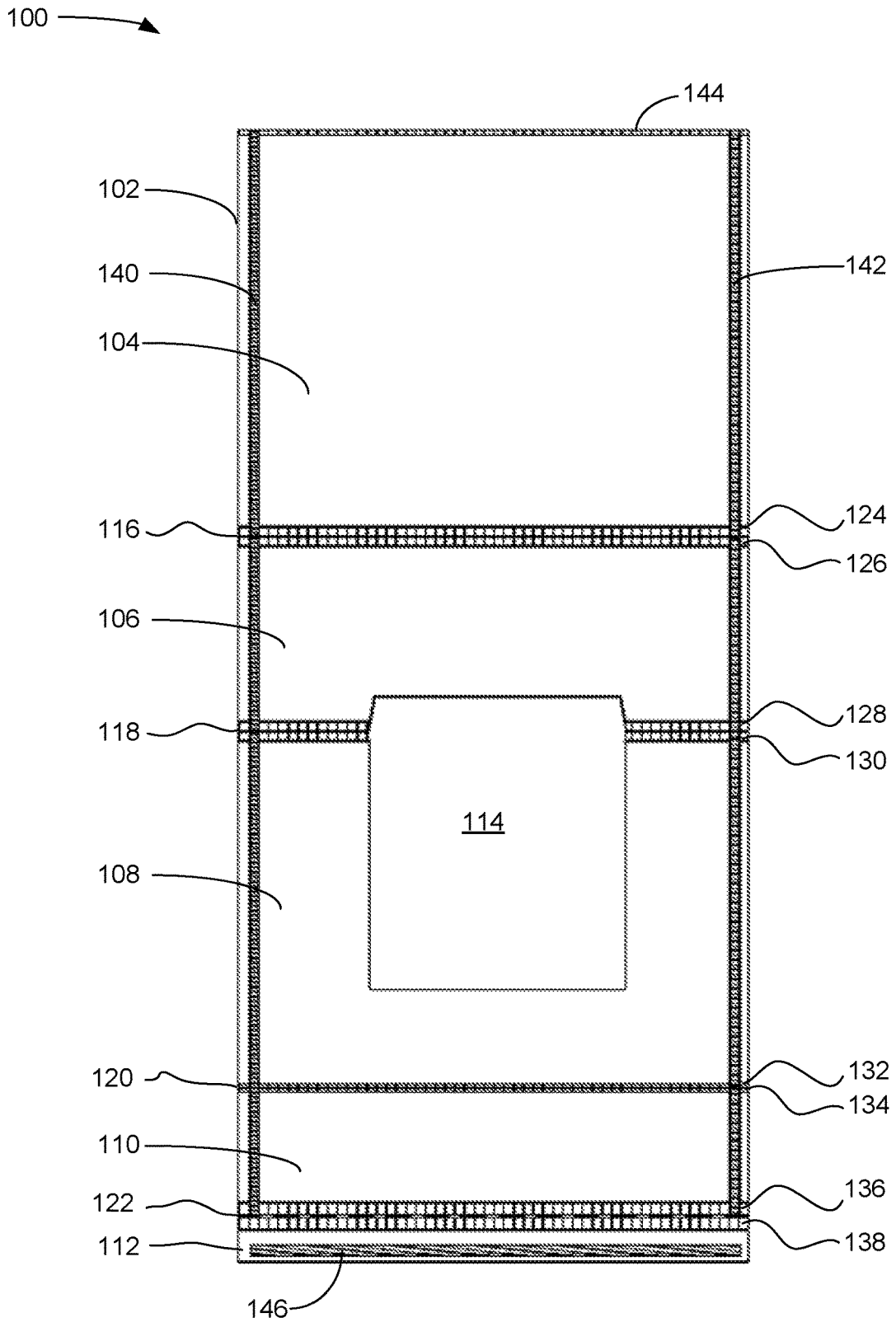
FIG. 1 is an interior side plan view illustrating an exemplary embodiment of the plastic acoustic enclosure, according to a preferred embodiment of the present invention.

FIG. 1 is an interior side plan view illustrating an exemplary embodiment of the plastic acoustic enclosure 100, according to a preferred embodiment of the present invention. The five-panel main body of plastic acoustic enclosure 100 is made from a single sheet 102 of corrugated plastic 702 (see FIG. 7) or similarly lightweight, foldable, and strong material. Corrugated plastic 702 is preferred, as it is strong, lightweight, acoustically compatible with loudspeakers, water resistant, dirt and dust resistant, insect resistant (including termites), can be painted, printed, or produced in various colors, and is readily fastened with adhesives. The single sheet 102 of corrugated plastic 702 (see FIG. 7) is divided into a plurality of panels 104, 106, 108, 110 and 112 by folding lines 116, 118, 120, and 122, respectively. Folding line 116 is the centerline of a V-shaped grove having groove sides 124 and 126, which are angled such that, when panel 104 is folded with respect to panel 106, the two panels close the groove sides 124 and 126 together. Folding line 118 is the centerline of a V-shaped grove having groove sides 128 and 130, which are angled such that, when panel 106 is folded with respect to panel 108, the two panels close the groove sides 128 and 130 together. Folding line 120 is the centerline of a V-shaped grove having groove sides 132 and 134, which are angled such that, when panel 108 is folded with respect to panel 110, the two panels 108 and 110 close the groove sides 132 and 134 together. Folding line 122 is the centerline of a V-shaped grove having groove sides 136 and 138, which are angled such that, when panel 110 is folded with respect to panel 112, the two panels 110 and 112 close the groove sides 136 and 138 together. In a various embodiments, a sound deadening material may be applied to any of the groove sides 124, 126, 128, 130, 132, 134, 136, and 138 to avoid plastic-on-plastic vibration noise. In various embodiments, the sound deadening material may be an adhesive sound deadening material. In various embodiments, sound deadening materials may be applied to any portion of the plastic acoustic enclosure 100.

Speaker support opening 114 extends from panel 108 into panel 110, crossing fold line 118. Panel 112 has an adhesive strip 146, preferably with a release layer (not shown), for securing panels 104, 106, 108, 110, and 112 in a folded configuration. Preferably, the adhesive is permanent. In various embodiments, adhesive may be applied my means other than adhesive strip 146, but the present embodiment is preferred. Side panel attachment features 140 and 142 assist in securing side panels 302 and 306 (see FIG. 3). Side panel attachment features 140 and 142 may be channels, adhesive strips with or without release layers, channels with adhesive strips with or without release layers, adhesive sound deadening materials with or without release layers, or channels with adhesive sound deadening materials with or without release layers. Edge 144 is beveled to abut panel 110 at an appropriate angle. The particular embodiment, when folded, has a unique cross sectional shape (see FIG. 11), but the invention is not limited to that shape, nor to any particular number of panels. Single sheet 102 may, for various embodiments, be of various thicknesses, as is appropriate for the size of the enclosure. Thicknesses in the range of ⅜ inches to ¾ inches are used in various embodiments.

Figure 2:
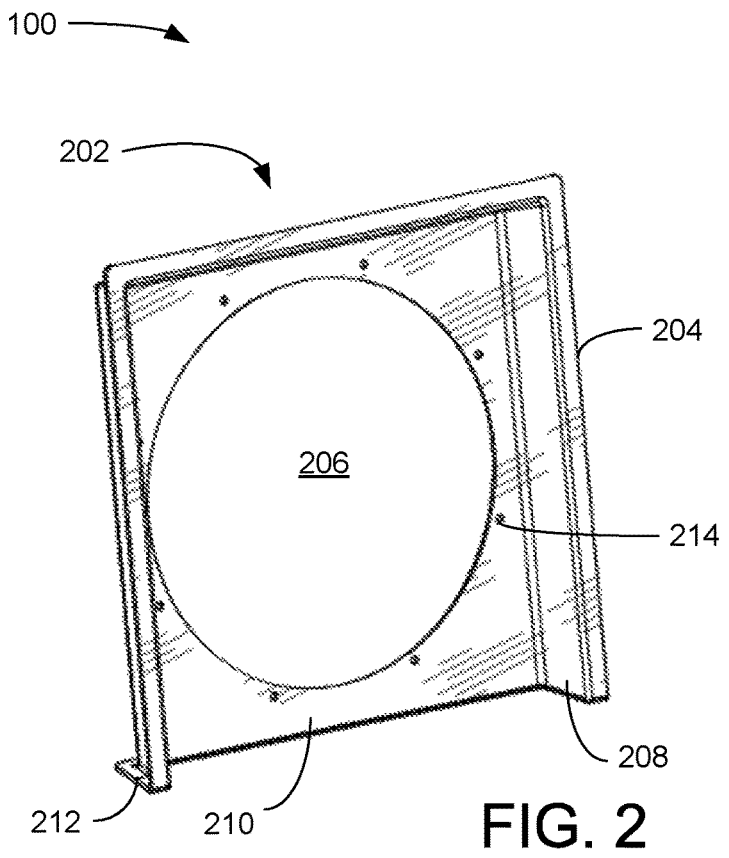
FIG. 2 is a front perspective view illustrating an exemplary embodiment of a speaker support of the exemplary plastic acoustic enclosure of FIG. 1, according to a preferred embodiment of the present invention.

FIG. 2 is a front perspective view illustrating an exemplary embodiment of a speaker support fixture 202 of the exemplary plastic acoustic enclosure 100 of FIG. 1, according to a preferred embodiment of the present invention. Speaker support fixture 202 made be made of any rigid material, such as, without limitation, metal or hard plastic. Speaker support fixture 202 may be made by metal stamping. Speaker support fixture 202 has a generally rectangular panel 210 having a speaker opening 206 and eight fastener openings 214 (one of eight labeled). Walls 208 (one of three labeled) extend obliquely and forward from three sides of rectangular panel 210 and support a rim 204, extends obliquely, outwardly, and continuously from walls 208, as shown. On the fourth (bottom) side of rectangular panel 210 a rim 212 extends angularly rearward from rectangular panel 210, with the rim 212 extending around the bottom ends of walls 208 to merge with rim 204. In operation, rim 212 will rest on the floor, shelf, or other environmental surface supporting the plastic acoustic enclosure 100 and so put the weight of the speaker on the speaker support fixture 202, rather than on the corrugated plastic of the plastic acoustic enclosure 100. Other shapes for rectangular panel 210 may be used in various embodiments. However, the present embodiment is preferred for simplicity of design and low cost.

Figure 3:
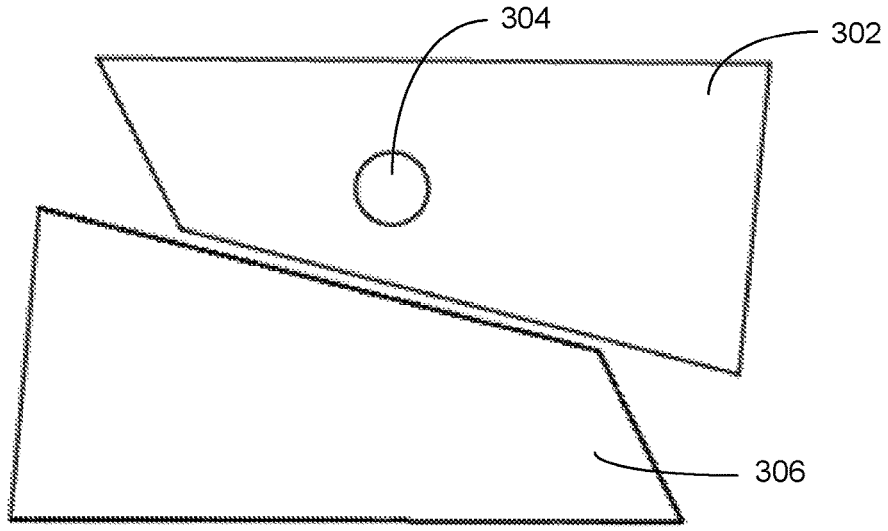
FIG. 3 is a top plan view illustrating an exemplary embodiment of side panels of the exemplary plastic acoustic enclosure of FIG. 1, according to a preferred embodiment of the present invention.

FIG. 3 is a top plan view illustrating an exemplary embodiment of side panels 302 and 306 of the exemplary plastic acoustic enclosure 100 of FIG. 1, according to a preferred embodiment of the present invention. Side panel 302 has an opening 304 for a speaker wiring connector plug 1004 (see FIG. 10). Side panel 306 is a mirror image of side panel 302, but without any openings. Side panels 302 and 306 are preferably made of corrugated plastic 702 (see FIG. 7).

Figure 4:
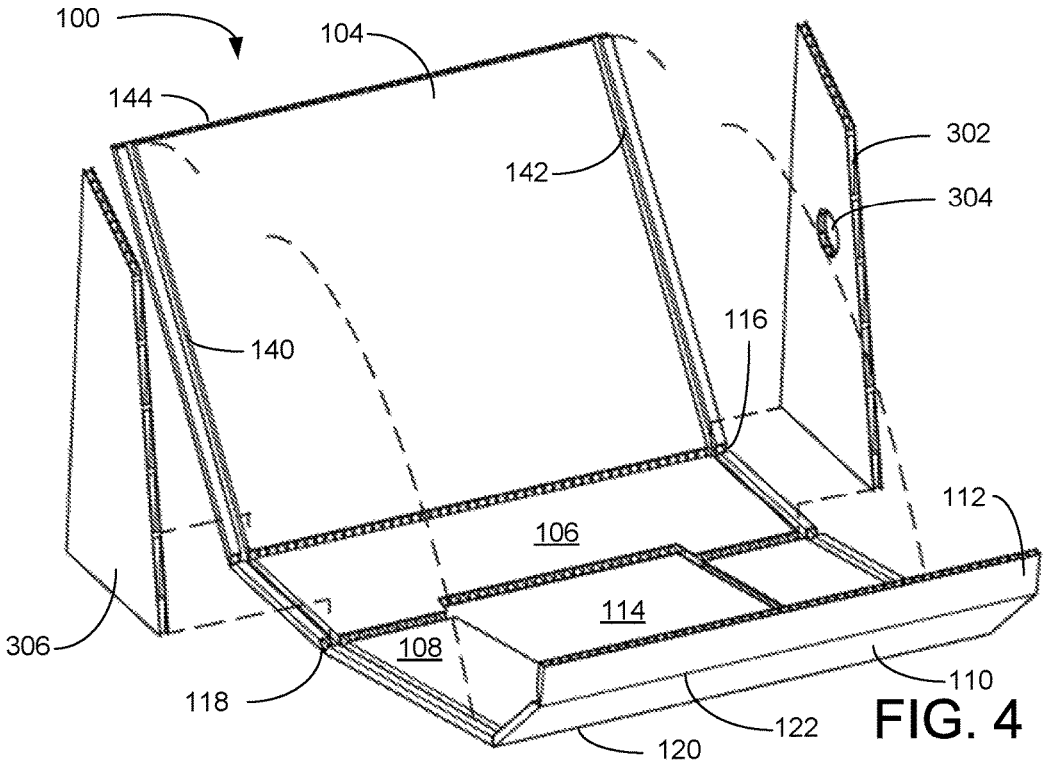
FIG. 4 is a front perspective exploded view illustrating the exemplary embodiment of the plastic acoustic enclosure of FIGS. 1 and 3, according to a preferred embodiment of the present invention.

FIG. 4 is a front perspective exploded view illustrating the exemplary embodiment of the plastic acoustic enclosure 100 of FIGS. 1 and 3, according to a preferred embodiment of the present invention. Panels 104, 110, and 112 are shown partially folded, and the positioning of left side panel 306 and right side panel 302 is shown in this intermediate step of assembly. The relationships of the edges of side panels 302 and 306 with the attachment features 142 and 140, respectively, can be clearly visualized from FIG. 4.

Figure 5:
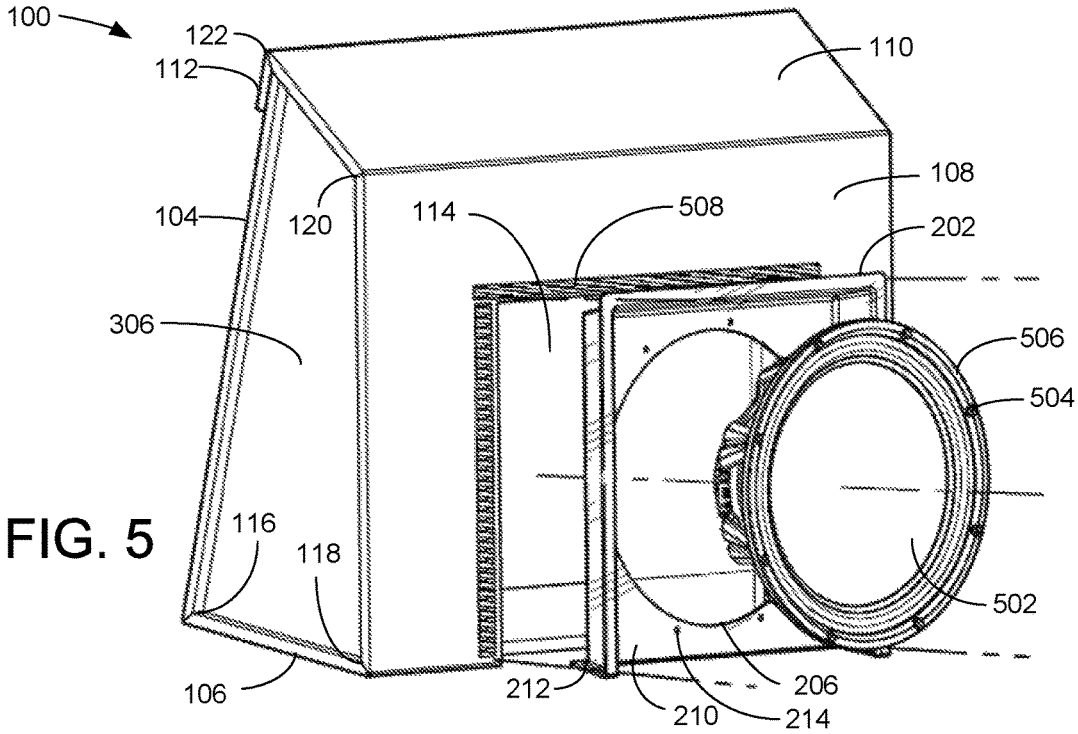
FIG. 5 is a front perspective exploded view illustrating the exemplary embodiment of the plastic acoustic enclosure of FIGS. 1-3, according to a preferred embodiment of the present invention.

FIG. 5 is a front perspective exploded view illustrating the exemplary embodiment of the plastic acoustic enclosure 100 of FIGS. 1-3, according to a preferred embodiment of the present invention. With the five panels 104, 106, 108, 110, and 112 and the side panels 306 and 302 assembled, speaker support fixture 202 and speaker 502 are shown in an intermediate step of assembly. Speaker support opening 114 is surrounded by adhesive strips 508 (one of two visible of four used) with release layers. Adhesive strips 508 adhere to the rear side of rim 204 and the top side of rim 212 when the speaker support fixture 202 is installed. Speaker 502 is then fastened to speaker support fixture 202 using fasteners, such as, without limitation, screws or bolts, through speaker fastener holes 504 in speaker basket rim 506 and through aligned fastener openings 214 in the speaker support fixture 202. In various embodiments, other shapes of speaker 502 and speaker support fixture 202 may be used. For non-limiting example, a square speaker 502 may be used, with adaptive modification of speaker support fixture 202.

Figure 6:
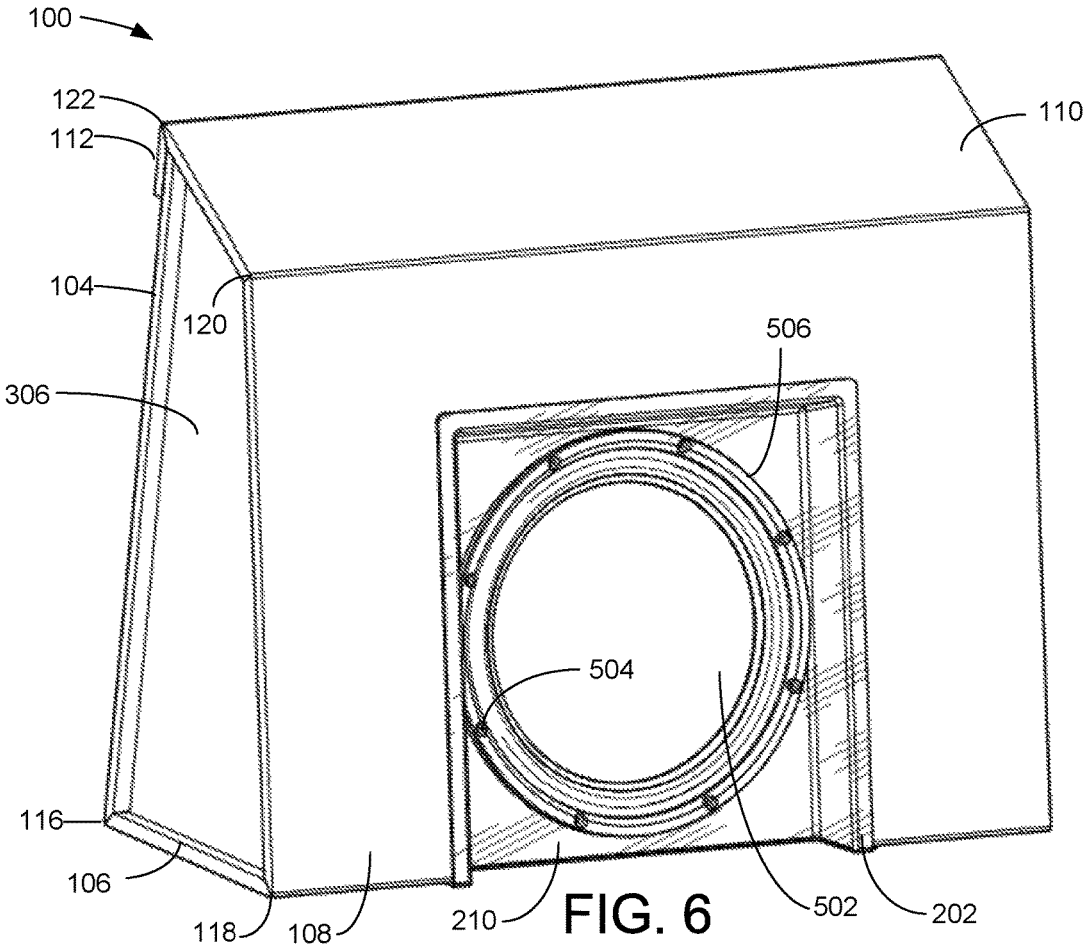
FIG. 6 is a front perspective view illustrating the exemplary embodiment of the plastic acoustic enclosure of FIG. 1, according to a preferred embodiment of the present invention.

FIG. 6 is a front perspective view illustrating the exemplary embodiment of the plastic acoustic enclosure 100 of FIG. 1, according to a preferred embodiment of the present invention. The fully assembled plastic acoustic enclosure 100 is shown. In various embodiments, considerable variation of the shape of the plastic acoustic enclosure 100, such as to fit within a cavity in an automobile, is possible, within the design constraints of using corrugated foldable plastic sheets, folded and secured adhesively, and adapted to support a speaker. All the embodiments 100, 1300, 2300, and 2900 presented herein, and others inferred or referred to, may be sold assembled, with speakers attached.

Figure 7:
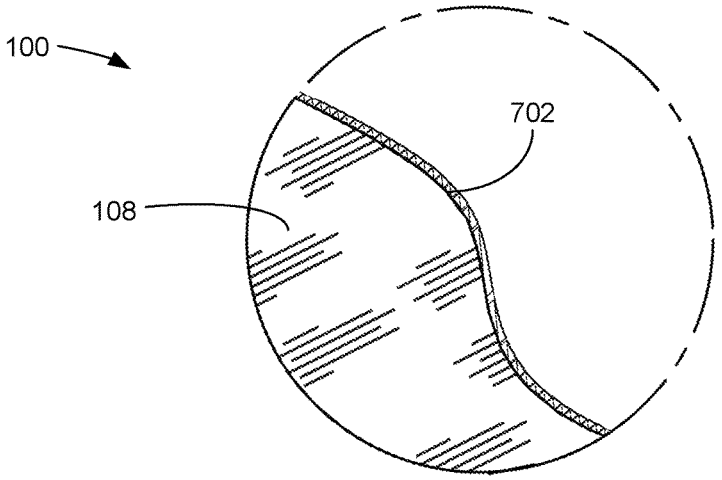
FIG. 7 is a top perspective cutaway view illustrating a detail of the exemplary embodiment of the plastic acoustic enclosure of FIG. 1, according to a preferred embodiment of the present invention.

FIG. 7 is a top perspective cutaway view illustrating a detail of the exemplary embodiment of the plastic acoustic enclosure 100 of FIG. 1, according to a preferred embodiment of the present invention. A cutaway detail of a piece of corrugated plastic 702 panel 108 is shown. Corrugated plastic sheets, such as corrugated plastic sheet 102, are commercially available. Plastic acoustic enclosure 100 is merely exemplary, and variations such as positioning of speaker support fixture 202, size and shape of the plastic acoustic enclosure 100, and angular orientation of speaker 502, are within the scope of the present invention.

Figure 8:
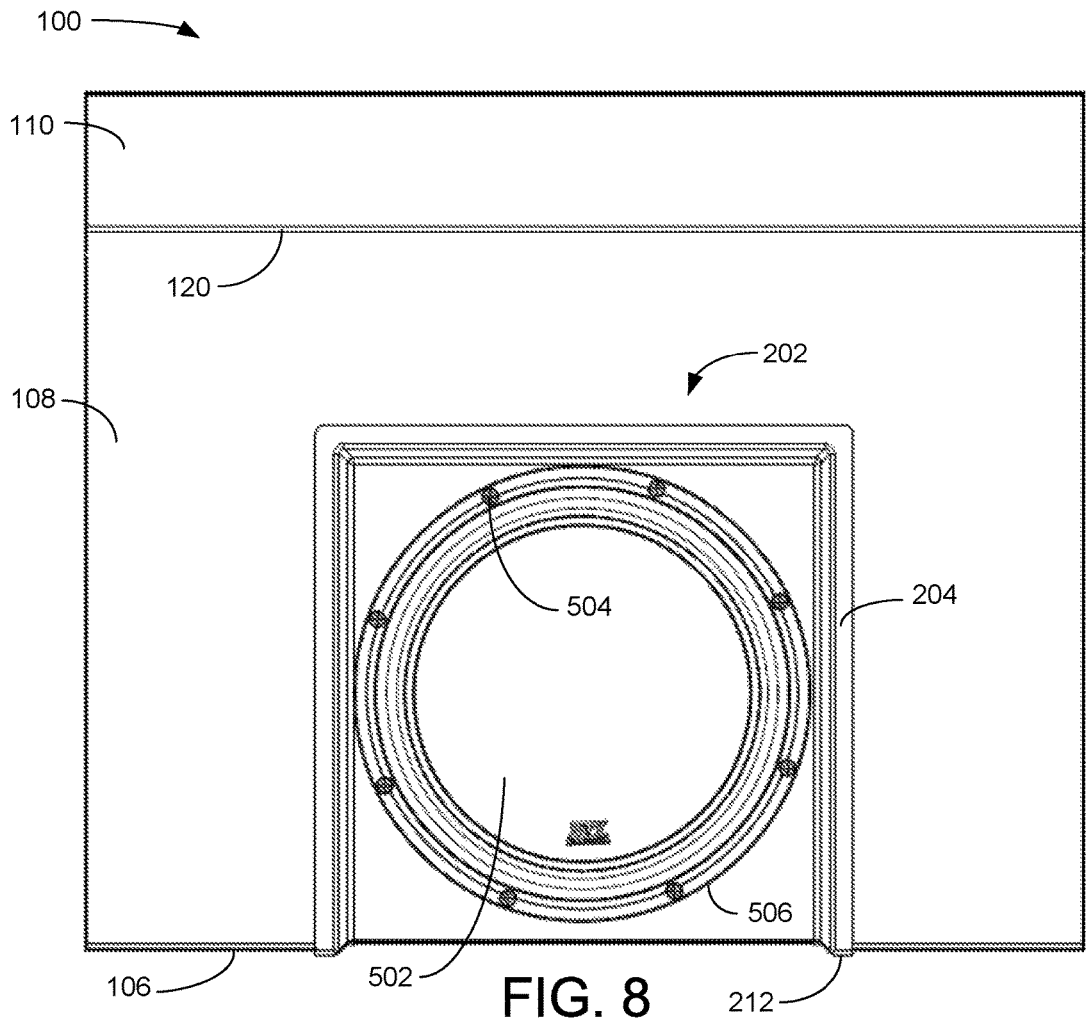
FIG. 8 is a front elevation view illustrating the exemplary embodiment of the plastic acoustic enclosure of FIG. 1, according to a preferred embodiment of the present invention.

FIG. 8 is a front elevation view illustrating the exemplary embodiment of the plastic acoustic enclosure 100 of FIG. 1, according to a preferred embodiment of the present invention. It is clear from FIG. 8 that the weight of speaker 502, attached to speaker support fixture 202, predominately rests on rim 212. Variation in the width of rim 212, adaptive to larger speakers 502 and larger plastic acoustic enclosures 100, are within the scope of the present invention.

Figure 9:
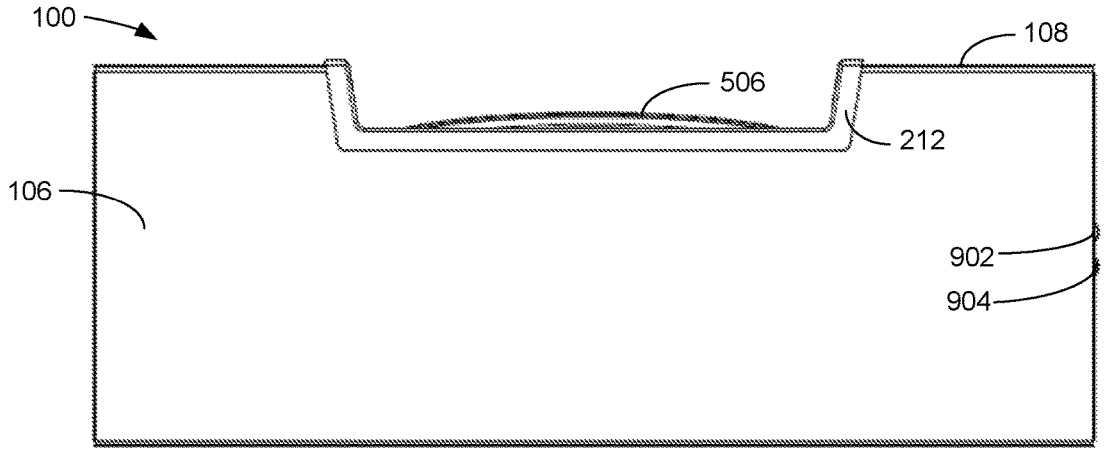
FIG. 9 is a bottom elevation view illustrating the exemplary embodiment of the plastic acoustic enclosure of FIG. 1, according to a preferred embodiment of the present invention.

FIG. 9 is a bottom elevation view illustrating the exemplary embodiment of the plastic acoustic enclosure 100 of FIG. 1, according to a preferred embodiment of the present invention. Rim 212 is fully shown. Speaker wiring connectors 902 and 904 can be seen on the right side.

Figure 10:
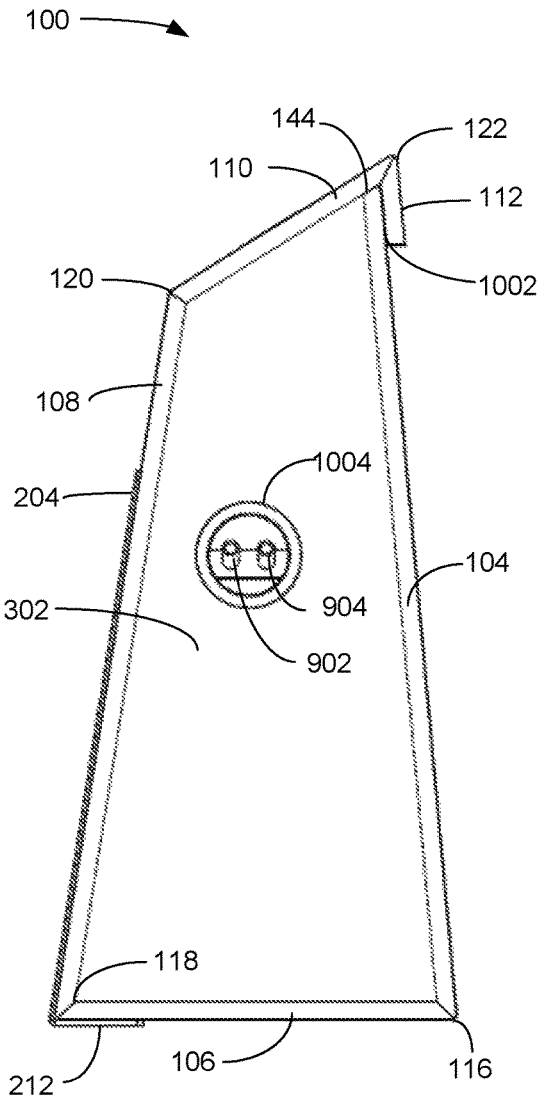
FIG. 10 is a right side elevation view illustrating the exemplary embodiment of the plastic acoustic enclosure of FIG. 1, according to a preferred embodiment of the present invention.

FIG. 10 is a right side elevation view illustrating the exemplary embodiment of the plastic acoustic enclosure 100 of FIG. 1, according to a preferred embodiment of the present invention. Right side panel 302 is shown installed as part of the plastic acoustic enclosure 100, with a speaker wiring connector plug 1004 installed in opening 304 of right side panel 302. Speaker wiring connector plug 1004 supports speaker wiring connectors 902 and 904, which provide external wiring connections from an external audio source to speaker 502. Adhesive bond 1002 between adhesive strip 146 of panel 112 to panel 104 secures side panels 302 and 306 and maintains the plastic acoustic enclosure 100 in its folded assembled configuration.

Figure 11:
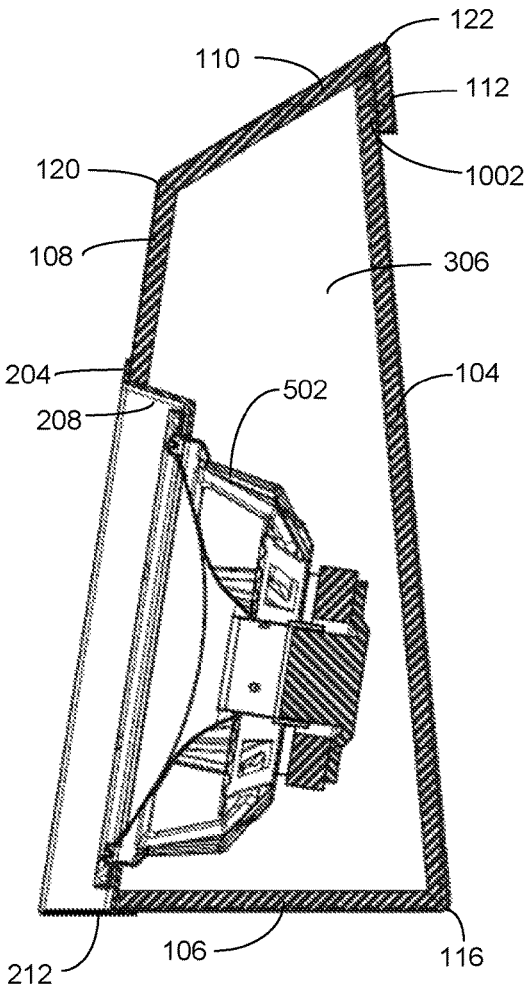
FIG. 11 is a side cross sectional view illustrating the exemplary embodiment of the plastic acoustic enclosure of FIG. 1, according to a preferred embodiment of the present invention.

FIG. 11 is a side cross sectional view illustrating the exemplary embodiment of the plastic acoustic enclosure 100 of FIG. 1, according to a preferred embodiment of the present invention. The relationship of the speaker 502 to the rim 212 can be best visualized in this view. Some torque force from the extent of the speaker 502 rearward of rim 212 will be opposed by panel 106, resting on an environmental support surface.

Figure 12:
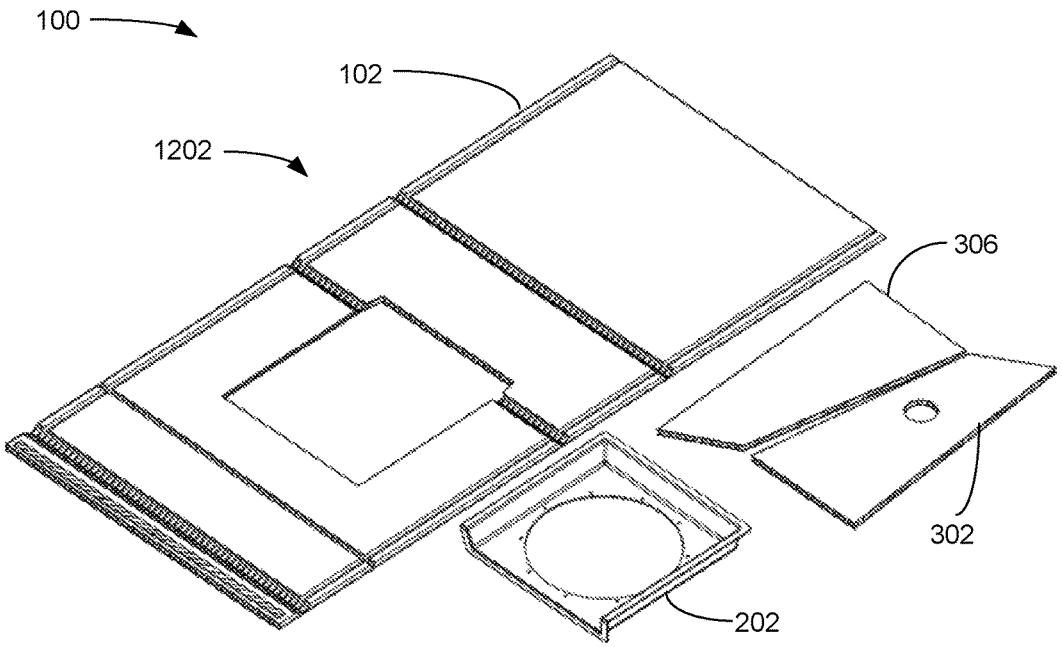
FIG. 12 is a top perspective view illustrating a shipping kit of the exemplary embodiment of the plastic acoustic enclosure of FIG. 1, according to a preferred embodiment of the present invention.

FIG. 12 is a top perspective view illustrating a shipping kit 1202 of the exemplary embodiment of the plastic acoustic enclosure 100 of FIG. 1, according to a preferred embodiment of the present invention. The plastic acoustic enclosure 100 can be shipped in reduced packaging due to being flat. In addition, because of the light weight of the plastic acoustic enclosure 100, shipping costs are substantially reduced as compared to wooden acoustic enclosures. When used as speaker enclosures in automobiles, the reduced weight of plastic acoustic enclosure 100 assists in improving gas mileage.

Figure 13:
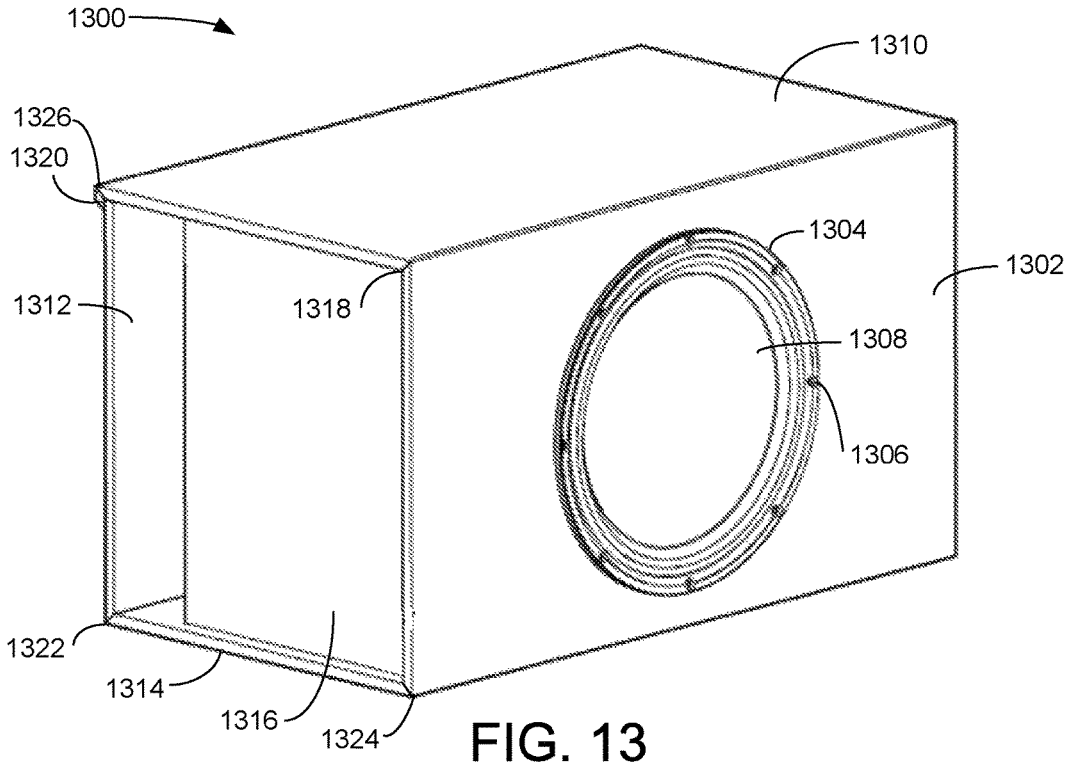
FIG. 13 is a front side perspective view illustrating a second exemplary embodiment of the plastic acoustic enclosure, according to a preferred embodiment of the present invention.

FIG. 13 is a front side perspective view illustrating a second exemplary embodiment of the plastic acoustic enclosure 1300, according to a preferred embodiment of the present invention. Plastic acoustic enclosure 1300 has an integrated flat-package amplifier 1702 (see FIG. 17), as will be discussed further below. The outer body of plastic acoustic enclosure 1300 has four main panels: back panel 1312, bottom panel 1314, front panel 1302, and top panel 1310, all of which are folded panels of a single sheet of corrugated plastic 1402 (see FIG. 14). The outer body of plastic acoustic enclosure 1300 also includes short adhesive panel 1320 which, upon assembly, adheres to the exterior surface of back panel 1312. Fold lines 1322, 1324, 1318, and 1326 are centerlines for corners. Fold line 1324 is between back panel 1312 and bottom panel 1314. Fold line 1324 is between bottom panel 1314 and front panel 1302. Fold line 1318 is between front panel 1302 and top panel 1310. Fold line 1326 is between top panel 1312 and short adhesive panel 1320. Front panel 1302 supports speaker 1308 having basket rim 1304 with fastener holes 1306 (one of eight labeled). Panel 1316 is part of an internal support structure 1524 (see FIG. 15).

Figure 14:
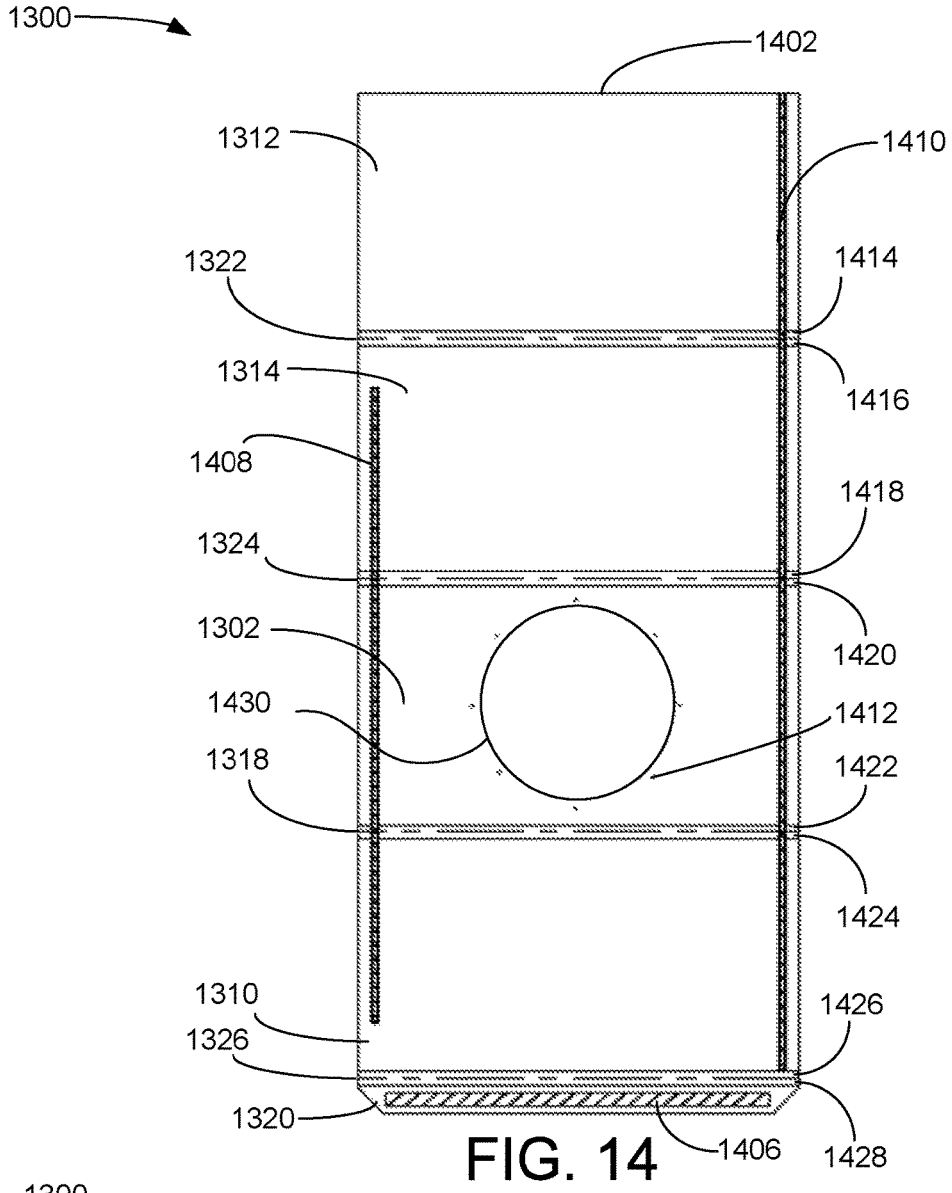
FIG. 14 is an inner side plan view illustrating the second exemplary embodiment of the plastic acoustic enclosure of FIG. 13, according to a preferred embodiment of the present invention.

FIG. 14 is an interior side plan view illustrating the second exemplary embodiment of the plastic acoustic enclosure 100 of FIG. 13, according to a preferred embodiment of the present invention. Single sheet of corrugated plastic 1402 includes back panel 1312, bottom panel 1314, front panel 1302, top panel 1310, and short adhesive panel 1320. Folding line 1322 is the centerline of a V-shaped grove having groove sides 1414 and 1416, which are angled such that, when back panel 1312 is folded with respect to bottom panel 1314, the two panels 1312 and 1314 close the groove sides 1414 and 1416 together to make a predetermined angle joint. Folding line 1324 is the centerline of a V-shaped grove having groove sides 1418 and 1420, which are angled such that, when bottom panel 1314 is folded with respect to front panel 1302, the two panels 1314 and 1302 close the groove sides 1418 and 1420 together to make a predetermined angle joint. Folding line 1318 is the centerline of a V-shaped grove having groove sides 1422 and 1424, which are angled such that, when front panel 1302 is folded with respect to top panel 1310, the two panels 1302 and 1310 close the groove sides 1422 and 1424 together to make a predetermined angle joint. Folding line 1326 is the centerline of a V-shaped grove having groove sides 1426 and 1428, which are angled such that, when panel 1310 is folded with respect to panel 1320, the two panels 1310 and 1320 close the groove sides 1426 and 1428 together to make a predetermined angle joint. In various embodiments, a sound deadening material may be applied to any of the groove sides 1414, 1416, 1418, 1320, 1422, 1424, 1426, and 1428 to avoid plastic-on-plastic vibration noise. In various embodiments, the sound deadening material may be an adhesive sound deadening material. Short adhesive panel 1320 supports an adhesive strip 1406 with a release layer for securing back panel 1312, bottom panel 1314, front panel 1302, top panel 1310, and short adhesive panel 1320 in a folded configuration. Preferably, the adhesive is permanent. Side panel attachment features 1408 and 1410 assist in securing side panels 1316 and 1702 (see FIG. 18). Side panel attachment features 1408 and 1410 may be channels, adhesive strips with release layers, channels with adhesive strips with release layers, adhesive sound deadening materials with release layers, or channels with adhesive sound deadening materials with release layers. Front panel 1302 has a speaker opening 1430 and multiple fastener openings 1412 (one of eight labeled). Preferably, for this embodiment, the predetermined folding angle is a right angle. In various embodiments, various panel sizes, shapes, and folding angles may be used. However, the present embodiment is preferred for simplicity of design and low cost.

Figure 15:
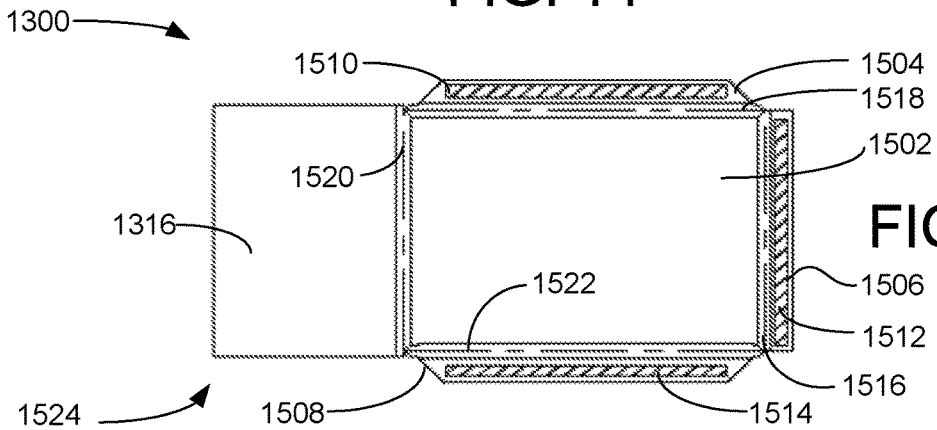
FIG. 15 is an inner side elevation view illustrating an internal support of the second exemplary embodiment of the plastic acoustic enclosure of FIG. 13, according to a preferred embodiment of the present invention.

FIG. 15 is an inner side elevation view illustrating an internal support 1524 of the second exemplary embodiment of the plastic acoustic enclosure 1300 of FIG. 13, according to a preferred embodiment of the present invention. Left side panel 1316 is coupled to interior rear panel 1502 across fold line 1520, which is grooved in a manner similar to the grooves of FIG. 14. Interior rear panel 1502 has top adhesive flange 1504, right side adhesive flange 1506, and bottom adhesive flange 1508 connected across grooved fold lines 1518, 1516, and 1522, respectively. Top adhesive flange 1504, right side adhesive flange 1506, and bottom adhesive flange 1508 support adhesive strips 1510, 1512, and 1514, with release layers, respectively. Preferably, interior rear panel 1502 and left side panel 1316 are of the illustrated shape. IN various embodiments, other shapes, adaptive to various panel sizes, shapes, and folding angles of corrugated sheet 1402 may be used.

Figure 16:
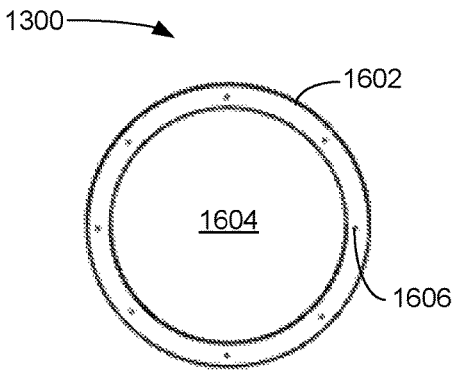
FIG. 16 is a front elevation view illustrating a support ring of the second exemplary embodiment of the plastic acoustic enclosure of FIG. 13, according to a preferred embodiment of the present invention.

FIG. 16 is a front elevation view illustrating a speaker support ring 1602 of the second exemplary embodiment of the plastic acoustic enclosure 1300 of FIG. 13, according to a preferred embodiment of the present invention. Speaker support ring 1602 is a flat annular ring, distinct from speaker 1308, of preferably rigid material with an opening 1604 that is preferably at least as large in diameter as speaker opening 1304. Speaker support ring 1602 has multiple support ring fastener openings 1606 that are alignable to fastener openings 1412 (one of eight labeled). In various embodiments, the external perimeter of speaker support ring 1602 need not be round, and may be any size consistent with space available for its use (see FIG. 18). The rigid material of support ring 1602 may be, for example and without limitation, metal, hard plastic, or a composite material.

Figure 17:
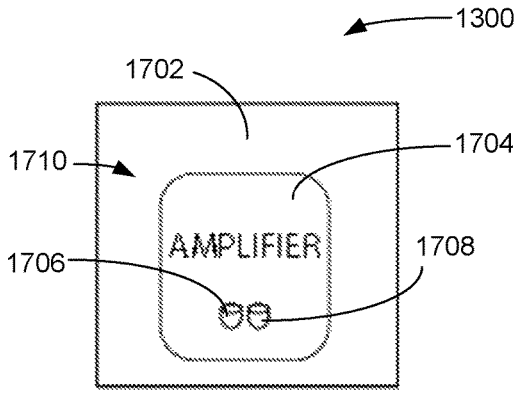
FIG. 17 is a front elevation view illustrating an exemplary amplifier panel of the second exemplary embodiment of the plastic acoustic enclosure of FIG. 13, according to a preferred embodiment of the present invention.

FIG. 17 is a front elevation view illustrating an exemplary right side panel 1702 of the second exemplary embodiment of the plastic acoustic enclosure 1300 of FIG. 13, according to a preferred embodiment of the present invention. Right side panel 1702 is preferably made of corrugated plastic 702 and supports a flat-package audio amplifier 1704 on exterior surface 1710. Audio amplifier 1704 supports audio signal wire connectors 1706 and 1708. The advantage of this design is that the audio amplifier 1704 is impedance matched to speaker 1308, and the user need only connect an external audio source to connectors 1706 and 1708 to obtain amplified audio from speaker 1308. Audio speaker wires from the output of audio amplifier 1704 connect through an opening in right side panel 1702 located behind audio amplifier 1704, and so is not visible in this view. In various embodiments, various sizes and shapes of audio amplifiers 1704 may be used, consistent with the size and shape of the particular plastic acoustic enclosure 1300.

Figure 18:
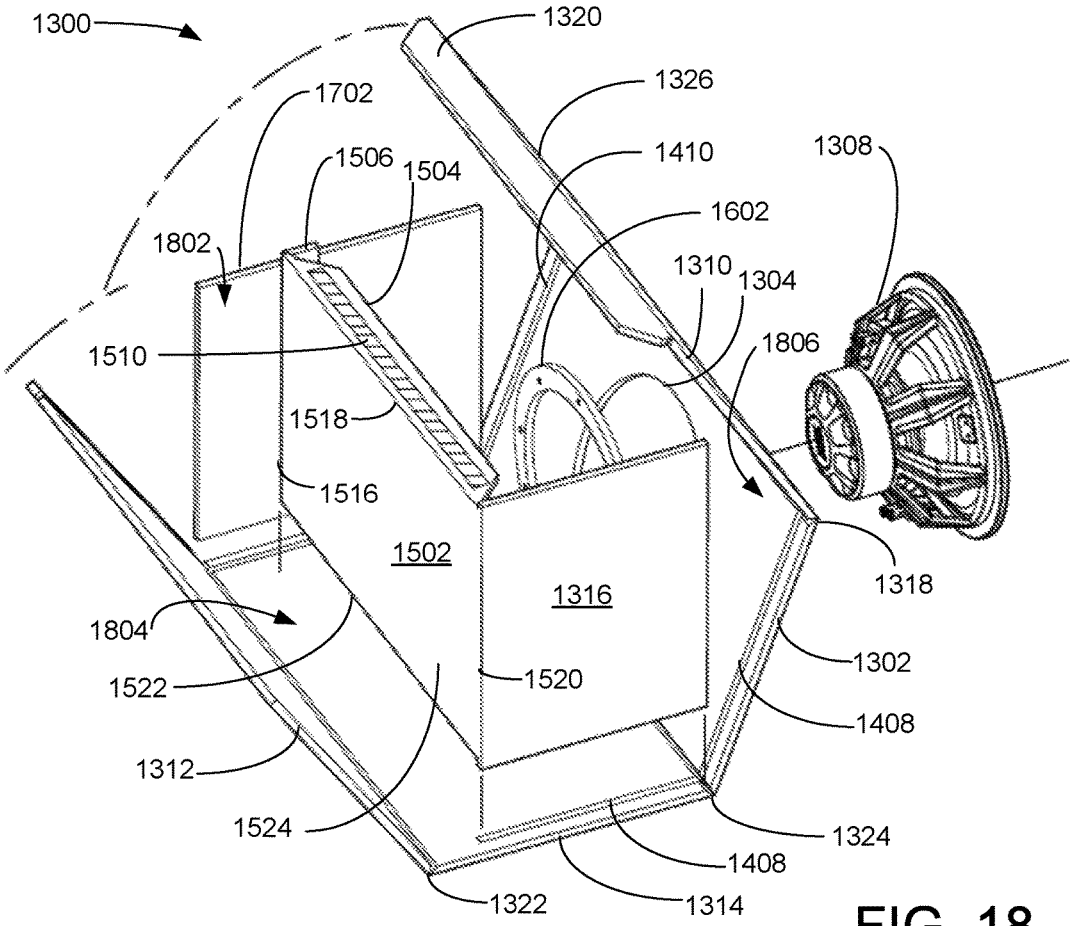
FIG. 18 is a top rear perspective exploded view illustrating the exemplary embodiment of the plastic acoustic enclosure of FIGS. 13-17, according to a preferred embodiment of the present invention.

FIG. 18 is a top rear perspective exploded view illustrating the exemplary embodiment of the plastic acoustic enclosure 1300 of FIGS. 13-17, according to a preferred embodiment of the present invention. Plastic acoustic enclosure 1300 is shown in an intermediate step of assembly. Left side panel 1316 is being attached on its bottom, front, and top edges to attachment feature 1408, and left side panel 1316 and internal rear panel 1502 have been fully folded along folding line 1520. Top adhesive flange 1504 and interior rear panel 1502 have been fully folded along folding line 1518, and adhesive strip 1510 is positioned to adhere to the underside of top panel 1310 as assembly proceeds. Right side adhesive flange 1506 and interior rear panel 1502 have been fully folded along folding line 1516, and adhesive strip 1512 (see FIG. 15) is positioned to adhere to the rear surface 1802 of right side panel 1702 as assembly proceeds. Bottom adhesive flange 1508 (not visible here) and interior rear panel 1502 have been fully folded along folding line 1522, and adhesive strip 1514 (not visible here) is positioned to adhere to the top surface 1804 of bottom panel 1314 as assembly proceeds. Right side panel 1702 is being attached on its bottom, front, top, and rear edges to attachment feature 1410. Once the internal support 1524 and right side panel 1702 are in place, support ring 1602 is attached, preferably adhesively, to the interior surface 1806 of front panel 1302 with support ring fastener openings 1606 aligned to front panel fastener openings 1412. Speaker 1308 is then attached to front panel 1302 via fasteners though fastener holes 1306 in speaker basket rim 1304 aligned to and through front panel fastener openings 1412 and support ring fastener openings 1606. With the speaker 1308 attached, the folding between panels 1312, 1302, 1310,1314 and 1320 may be completed.

Figure 19:
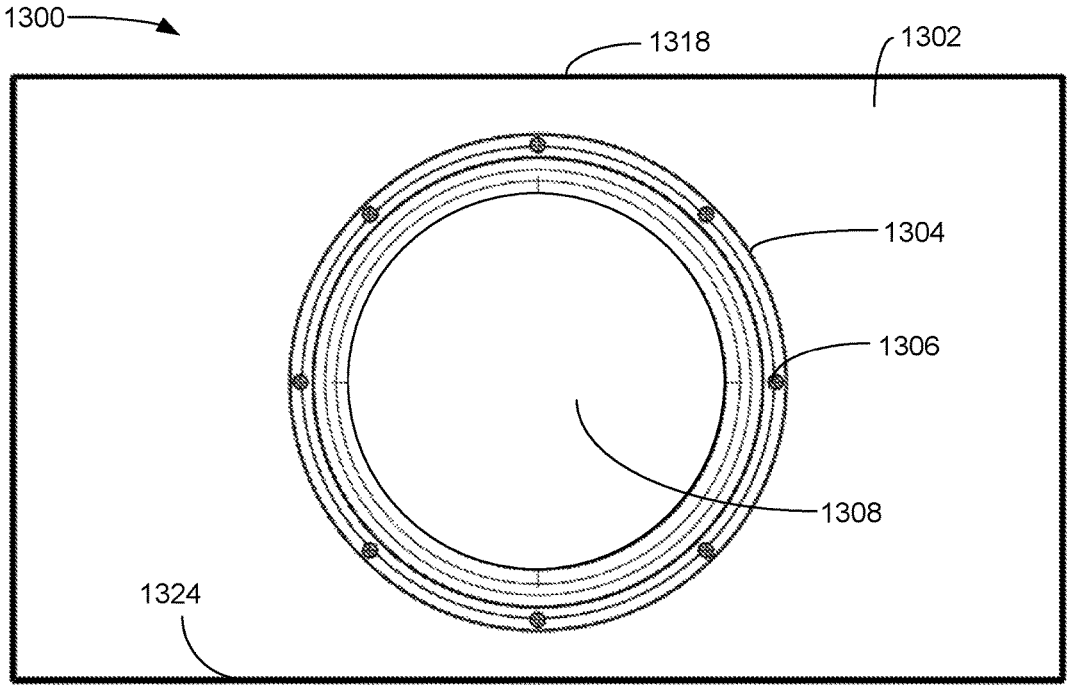
FIG. 19 is a front elevation view illustrating the second exemplary embodiment of the plastic acoustic enclosure of FIG. 13, according to a preferred embodiment of the present invention.

FIG. 19 is a front elevation view illustrating the second exemplary embodiment of the plastic acoustic enclosure 1300 of FIG. 13, according to a preferred embodiment of the present invention. Speaker 1308 is shown substantially centered on front panel 1302, but that is not a limitation of the present invention. Likewise, the circular shape of speaker 1308 is not a limitation of the present invention.

Figure 20:
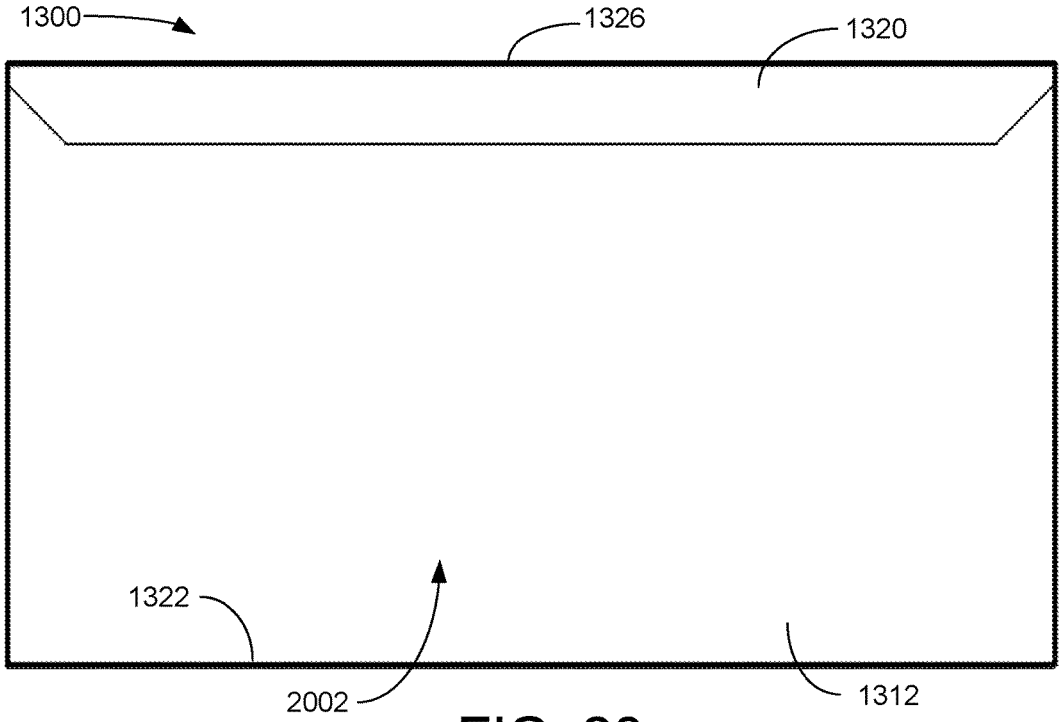
FIG. 20 is a rear elevation view illustrating the second exemplary embodiment of the plastic acoustic enclosure of FIG. 13, according to a preferred embodiment of the present invention.

FIG. 20 is a rear elevation view illustrating the second exemplary embodiment of the plastic acoustic enclosure 1300 of FIG. 13, according to a preferred embodiment of the present invention. Short adhesive panel 1320 is shown fully folded along fold line 1326 and adhered to the rear surface 2002 of rear panel 1312.

Figure 21:
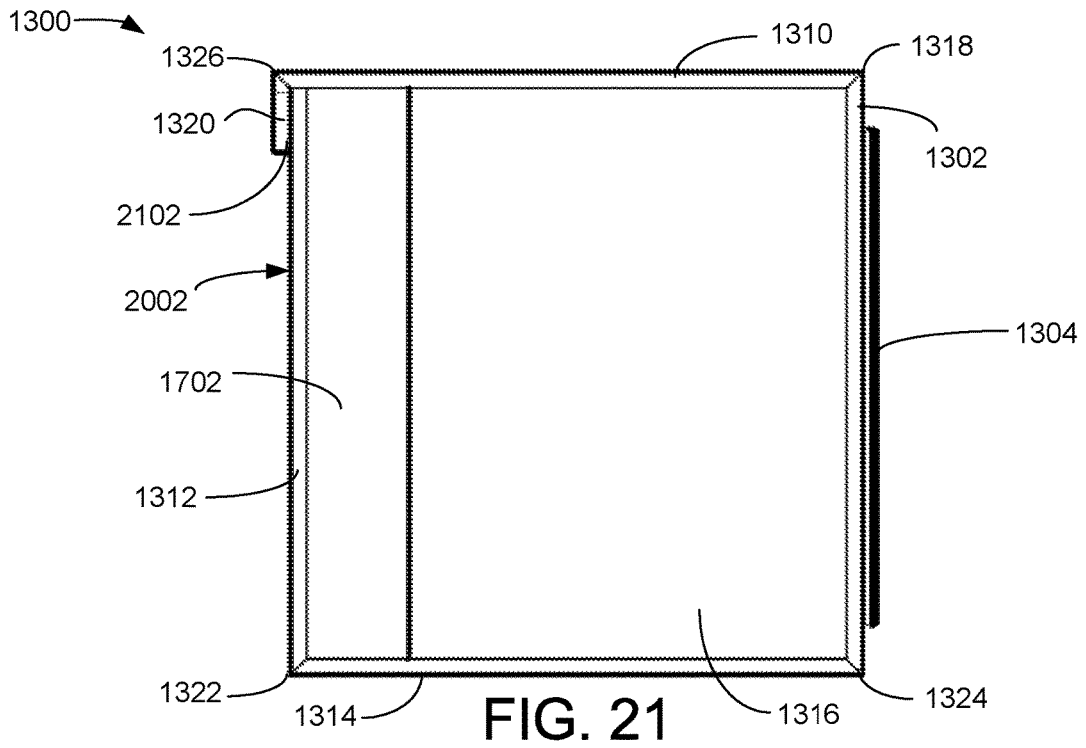
FIG. 21 is a left side elevation view illustrating the second exemplary embodiment of the plastic acoustic enclosure of FIG. 13, according to a preferred embodiment of the present invention.

FIG. 21 is a left side elevation view illustrating the second exemplary embodiment of the plastic acoustic enclosure 1300 of FIG. 13, according to a preferred embodiment of the present invention. Adhesive joint 2102 between short adhesive panel 1320 and the rear surface 2002 of rear panel 1312 can best be seen in this view.

Figure 22:
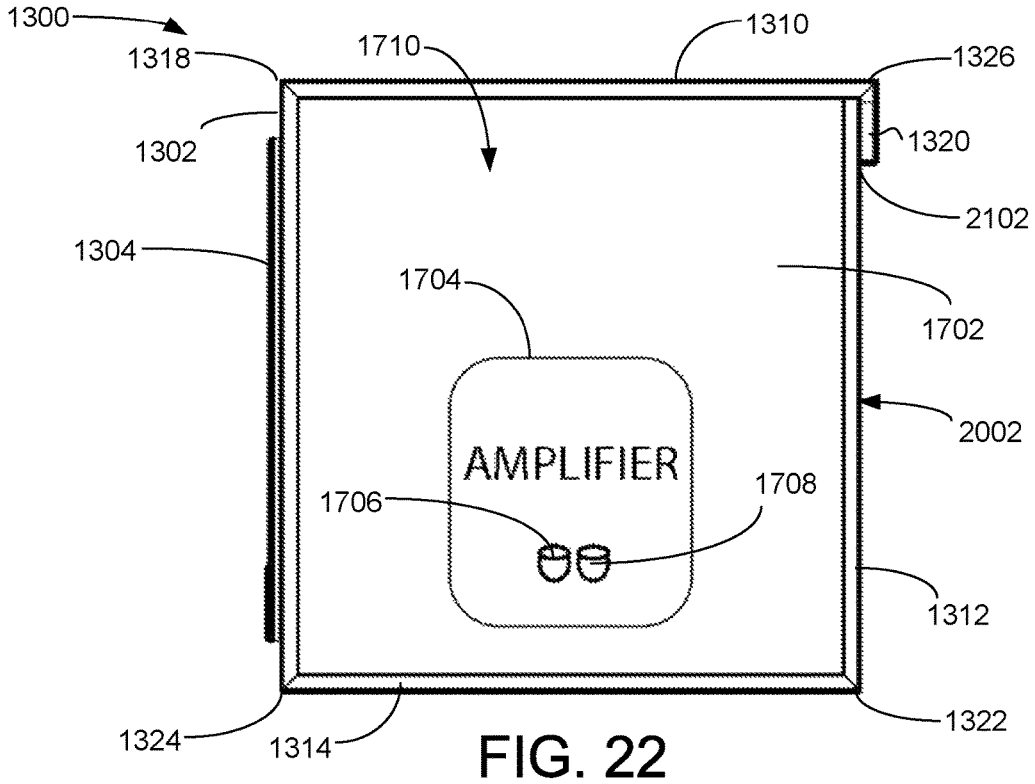
FIG. 22 is a right side elevation view illustrating the second exemplary embodiment of the plastic acoustic enclosure of FIG. 13, according to a preferred embodiment of the present invention.

FIG. 22 is a right side elevation view illustrating the second exemplary embodiment of the plastic acoustic enclosure 1300 of FIG. 13, according to a preferred embodiment of the present invention. The advantages in having the amplifier 1704 on an exterior surface 1710 of the right side panel 1702 include ease of access for the user and improved heat dissipation from the amplifier 1704. In various other embodiments, amplifier 1704 may be attached to any external surface of the plastic acoustic enclosure 1300. Any of the embodiments 100, 1300, 2300, and 2900 illustrated herein, or inferred or referred to, may receive an amplifier 1704.

Figure 23:
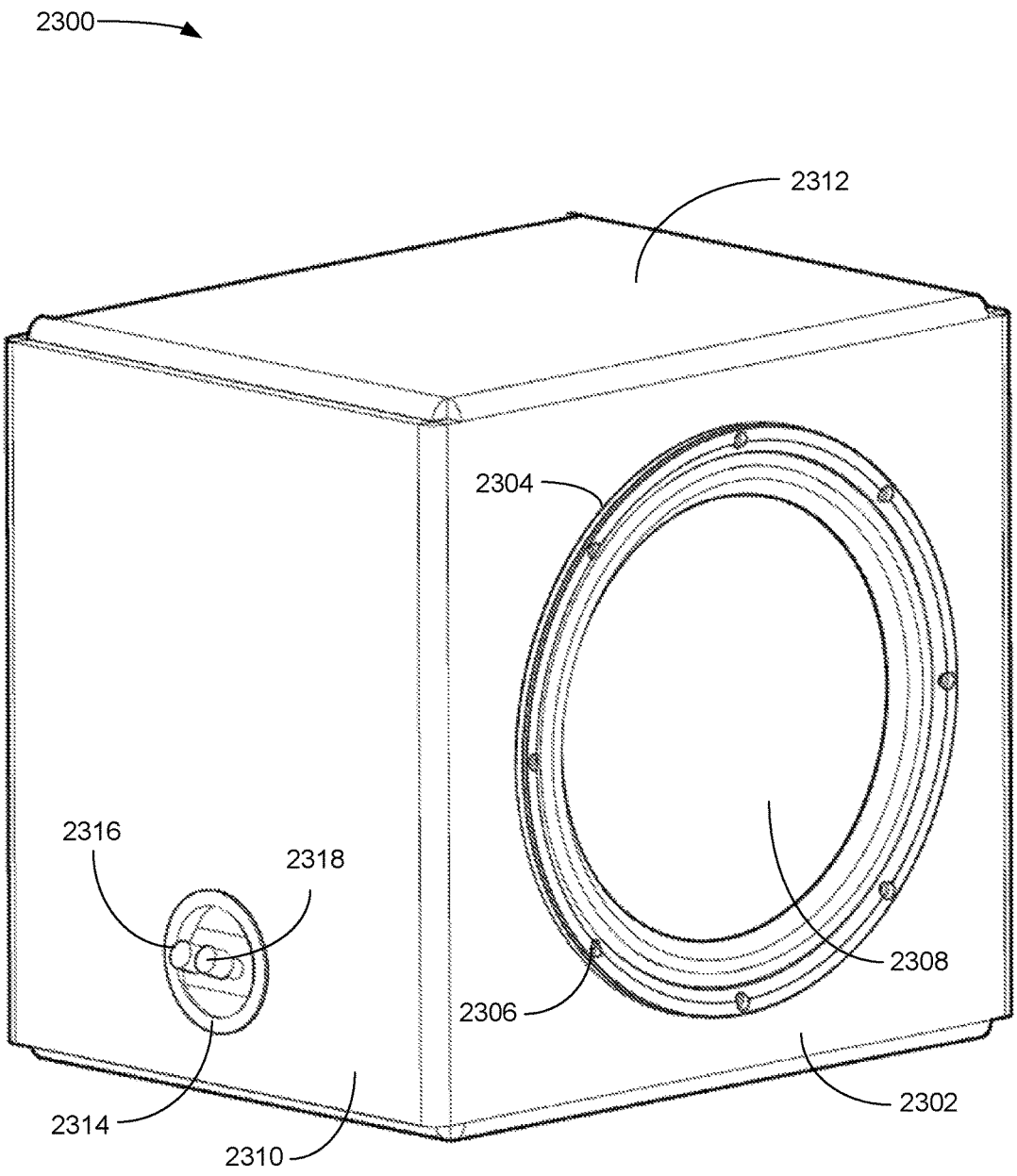
FIG. 23 is a front-side perspective view illustrating a third exemplary embodiment of the plastic acoustic enclosure, according to a preferred embodiment of the present invention.

FIG. 23 is a front-side perspective view illustrating a third exemplary embodiment of the plastic acoustic enclosure 2300, according to a preferred embodiment of the present invention. Front panel 2302 supports speaker 2308 having a speaker basket rim 2304 having rim fastener openings 2306 (one of eight labeled). Left side panel 2310 supports connector plug 2314 which, in turn, supports audio signal wire connectors 2316 and 2318. Top panel 2312 suggests, correctly, that the plastic acoustic enclosure 2300 is generally in the shape of a box. The shape of the plastic acoustic enclosure 2300 and the shape of speaker 2308 are not limitations of the present invention. However, the present embodiment 2300 is preferred for simplicity of design and economy of production.

Figure 24:
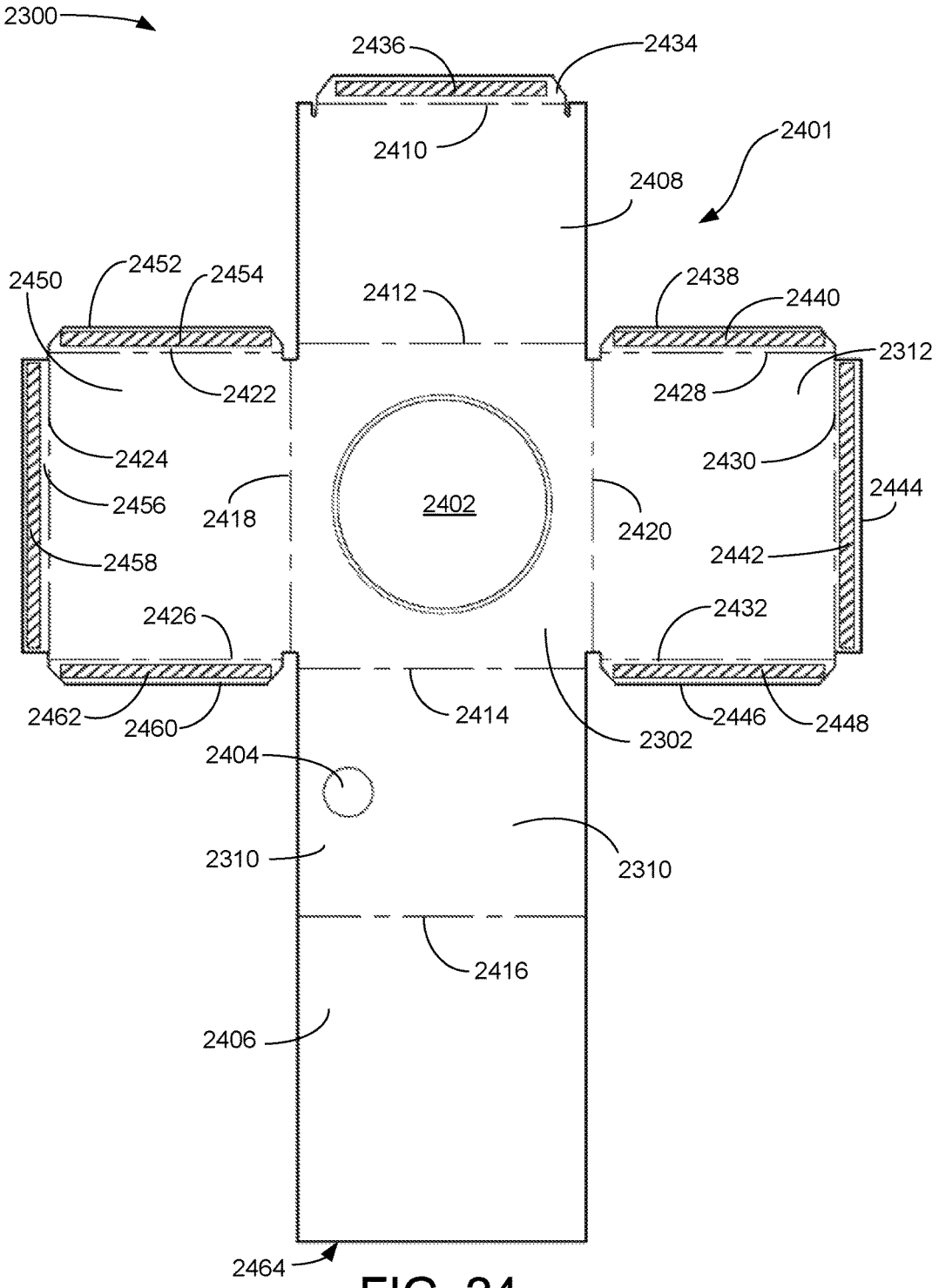
FIG. 24 is an exterior side plan view illustrating the third exemplary embodiment of the plastic acoustic enclosure of FIG. 23, according to a preferred embodiment of the present invention.

FIG. 24 is an interior side plan view illustrating the third exemplary embodiment of the plastic acoustic enclosure 2300 of FIG. 23, according to a preferred embodiment of the present invention. Corrugated plastic sheet 2401 includes front panel 2302, left side panel 2310, rear panel 2406, right side panel 2408, top panel 2312, and bottom panel 2450. Folding line 2410 is the centerline of a V-shaped grove (similar to those shown in detail in FIG. 1 and FIG. 14, and not repeated here). Folding line 2410 is between front panel 2302 and short adhesive panel 2434 and is the centerline of a V-shaped groove. Short adhesive panel 2434 supports adhesive strip 2436. The V-shaped groove is similar to those described in regard to previous embodiments and has groove sides which are angled such that, when short adhesive panel 2434 is folded with respect to panel 2408, the two panels 2434 and 2408 close the groove sides together to make a predetermined angle. Folding line 2412 is the centerline of a V-shaped grove (similar to those shown in detail in FIG. 1 and FIG. 14, and not repeated here). Folding line 2412 is between right side panel 2408 and front panel 2302. The V-shaped groove is similar to those described in regard to previous embodiments and has groove sides which are angled such that, when panel 2408 is folded with respect to panel 2302, the two panels 2408 and 2302 close the groove sides together to make a predetermined angle. Folding line 2414 is the centerline of a V-shaped grove (similar to those shown in detail in FIG. 1 and FIG. 14, and not repeated here). Folding line 2414 is between left side panel 2310 and front panel 2302. The V-shaped groove is similar to those describes in regard to previous embodiments and has groove sides which are angled such that, when panel 2310 is folded with respect to panel 2302, the two panels 2310 and 2302 close the groove sides together to make a predetermined angle. Opening 2404 is adapted to receive connector plug 2314. Folding line 2416 is between left side panel 2310 and rear panel 2406. The V-shaped groove is similar to those described in regard to previous embodiments and has groove sides which are angled such that, when panel 2310 is folded with respect to panel 2406, the two panels 2310 and 2406 close the groove sides together to make a predetermined angle. Folding line 2420 is between top panel 2312 and front panel 2302. The V-shaped groove is similar to those described in regard to previous embodiments and has groove sides which are angled such that, when panel 2312 is folded with respect to panel 2302, the two panels 2312 and 2302 close the groove sides together to make a predetermined angle. Folding line 2418 is between bottom panel 2450 and front panel 2302. The V-shaped groove is similar to those described in regard to previous embodiments and has groove sides which are angled such that, when panel 2450 is folded with respect to panel 2302, the two panels 2450 and 2302 close the groove sides together to make a predetermined angle. In a various embodiments, a sound deadening material may be applied to any of the groove sides to avoid plastic-on-plastic vibration noise. Folding lines 2410, 2412, 2414, 2416, 2418, and 2420 fold toward the observer (out of the page) of FIG. 24, while folding lines 2422, 2424, 2426, 2428, 2430, and 2432 fold away from the observer (into the page) of FIG. 24.

Top panel 2312 includes right side top adhesive flange 2438, rear side top adhesive flange 2444, and left side top adhesive flange 2446 which are 1508 connected across grooved fold lines 2438, 2430, and 2432, respectively. Right side top adhesive flange 2438, rear side top adhesive flange 2444, and left side top adhesive flange 2446 support adhesive strips 2440, 2444, and 2448, with release layers, respectively. Bottom panel 2450 includes right side bottom adhesive flange 2452, rear side bottom adhesive flange 2456, and left side bottom adhesive flange 2460 which are connected across grooved fold lines 2422, 2424, and 2426, respectively. Right side bottom adhesive flange 2452, rear side bottom adhesive flange 2456, and left side bottom adhesive flange 2460 support adhesive strips 2454, 2458, and 2462, with release layers, respectively. Rear panel edge 2464 is not beveled in this embodiment.

Figure 25:
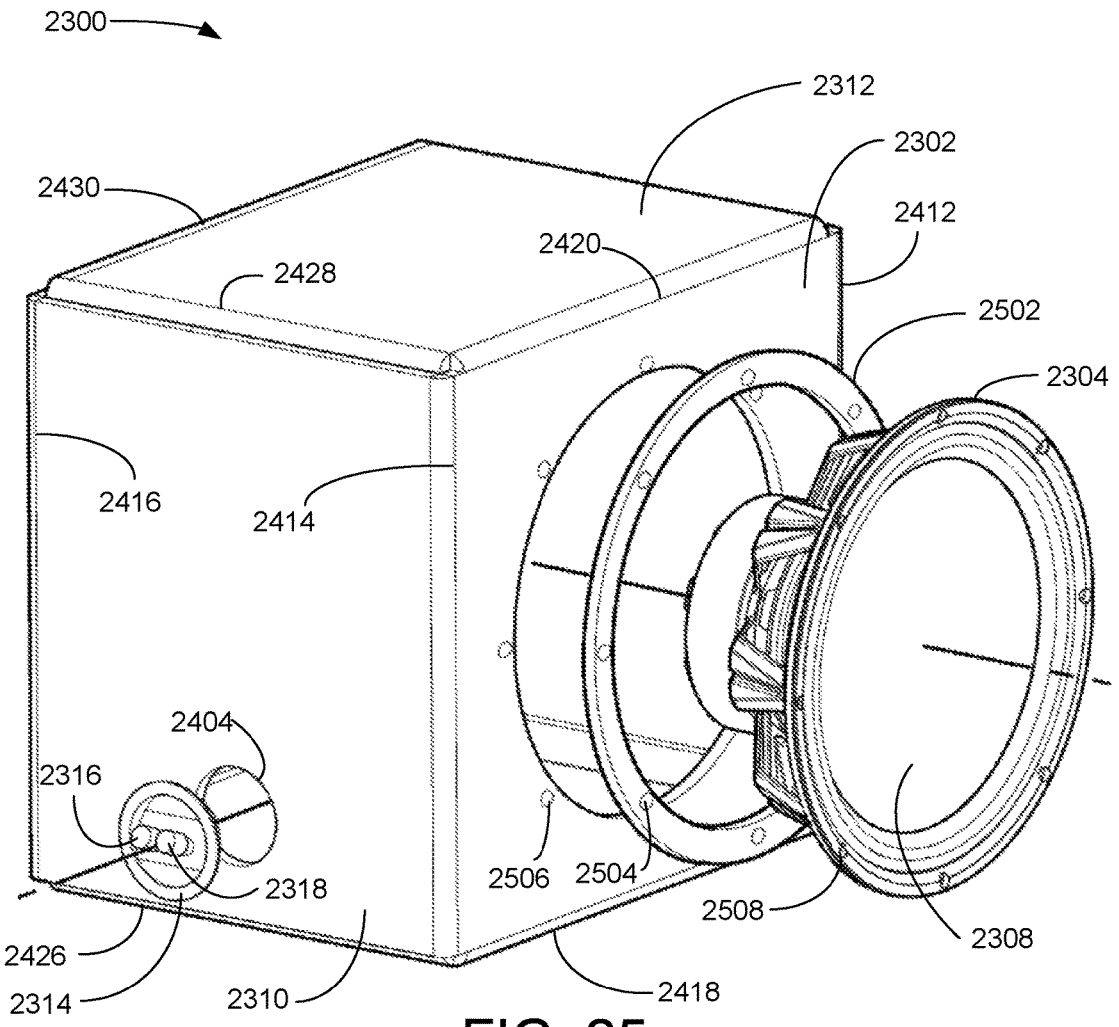
FIG. 25 is a front-side perspective exploded view illustrating the third exemplary embodiment of the plastic acoustic enclosure of FIG. 23, according to a preferred embodiment of the present invention.

FIG. 25 is a front-side perspective exploded view illustrating the third exemplary embodiment of the plastic acoustic enclosure 2300 of FIG. 23, according to a preferred embodiment of the present invention. Plastic acoustic enclosure 2300 is shown in an intermediate step of assembly. Speaker support ring 2502 has fastener openings 2504 (one of six visible labeled of eight used) that align with front panel fastener openings 2506 (one of five visible labeled of eight used) and speaker rim fastener openings 2508 (to receive fasteners to fasten speaker 2308 to front panel 2302. In an embodiment, speaker support ring 2502 may be installed on the interior surface of front panel 2302. Speaker support ring 2502 is preferably made of a rigid material such as, without limitation, metal, hard plastic, or composite material.

Figure 26:
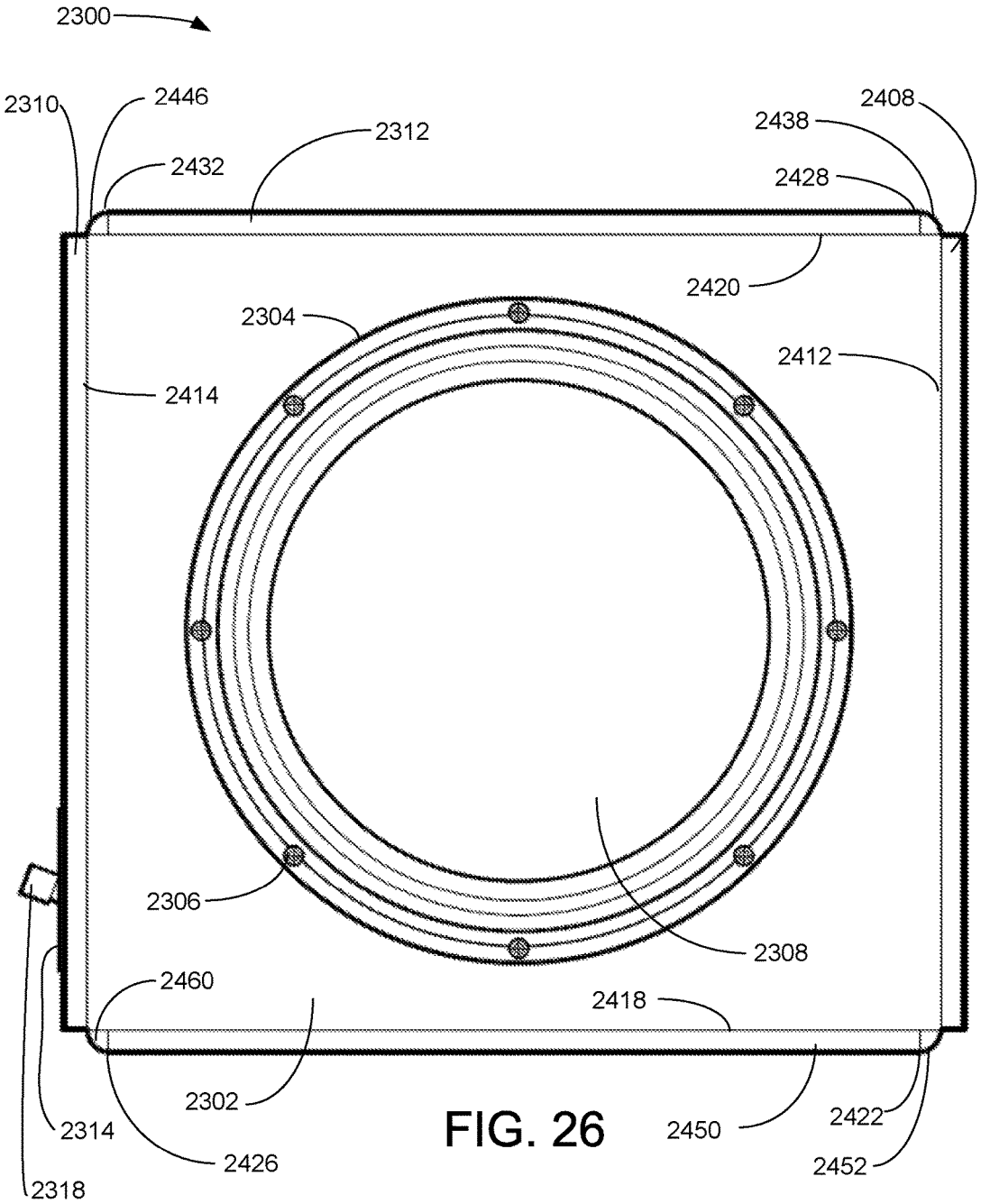
FIG. 26 is a front elevation view illustrating the third exemplary embodiment of the plastic acoustic enclosure of FIG. 23, according to a preferred embodiment of the present invention.

FIG. 26 is a front elevation view illustrating the third exemplary embodiment of the plastic acoustic enclosure 2300 of FIG. 23, according to a preferred embodiment of the present invention. The folding along panel fold lines 2412, 2414, 2418 and 2420 can be seen, as well as fold lines 2422, 2426, 2428, and 2432 of adhesive flanges 2452, 2460, 2438, and 2446, respectively.

Figure 27:
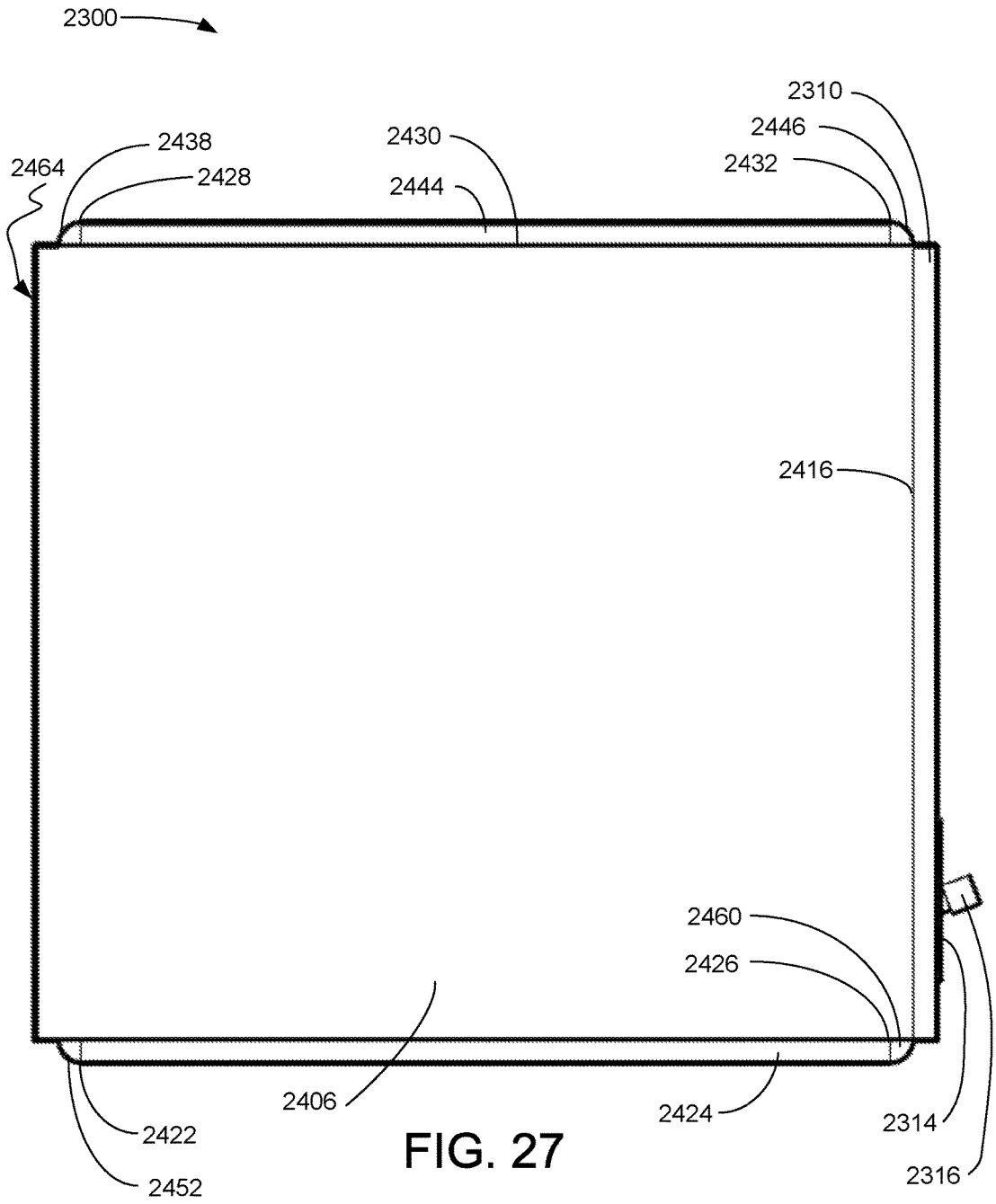
FIG. 27 is a rear elevation view illustrating the third exemplary embodiment of the plastic acoustic enclosure of FIG. 23, according to a preferred embodiment of the present invention.

FIG. 27 is a rear elevation view illustrating the third exemplary embodiment of the plastic acoustic enclosure 2300 of FIG. 23, according to a preferred embodiment of the present invention. The folding along panel fold line 2416 and rear panel edge 2464 can be seen, as well as fold lines 2422, 2426, 2428, and 2432 of adhesive flanges 2452, 2460, 2438, and 2446, respectively.

Figure 28:
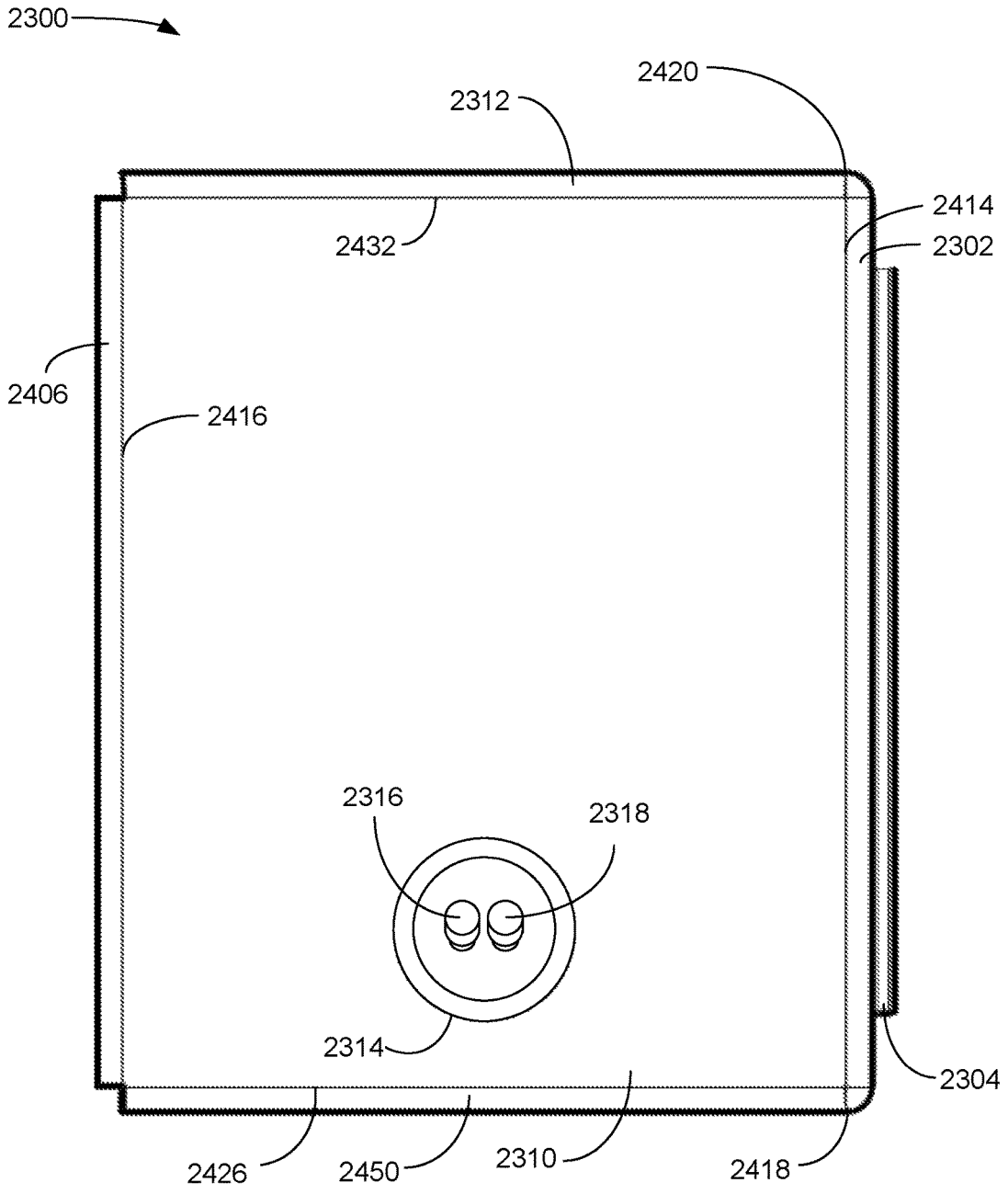
FIG. 28 is a left side elevation view illustrating the third exemplary embodiment of the plastic acoustic enclosure of FIG. 23, according to a preferred embodiment of the present invention.

FIG. 28 is a left side elevation view illustrating the third exemplary embodiment of the plastic acoustic enclosure 2300 of FIG. 23, according to a preferred embodiment of the present invention. Panel fold lines 2414, 2416, 2418, and 2420 can be seen as well as adhesive flange fold lines 2426 and 2432 for adhesive flanges 2460 and 2446, respectively.

Figure 29:
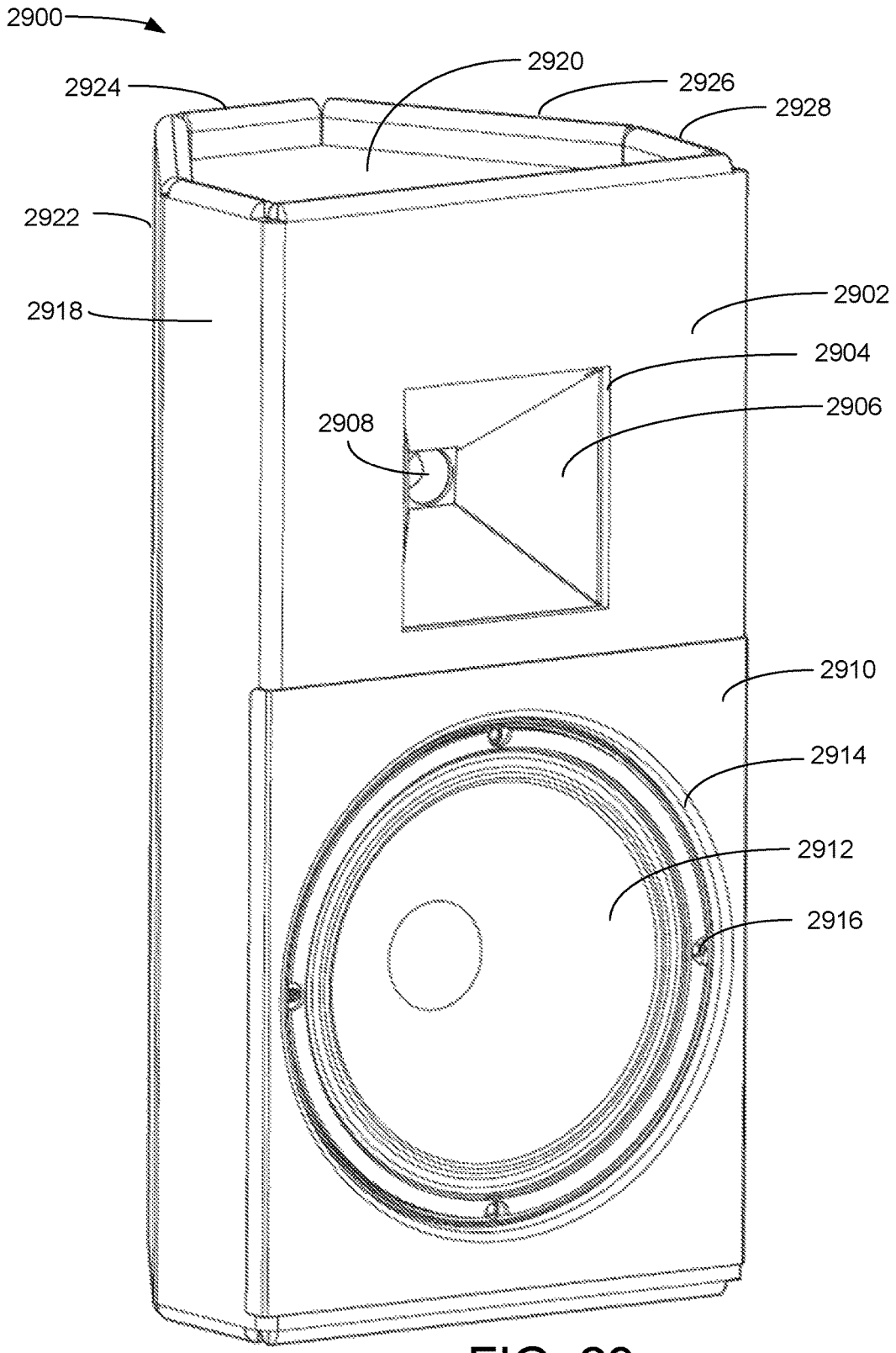
FIG. 29 is a front-side perspective view illustrating a fourth exemplary embodiment of the plastic acoustic enclosure, according to a preferred embodiment of the present invention.

FIG. 29 is a front-side perspective view illustrating a fourth exemplary embodiment of the plastic acoustic enclosure 2900, according to a preferred embodiment of the present invention. Five-sided plastic acoustic enclosure 2900 includes front panel 2902, preferably made of corrugated plastic 702. Front panel 2902 has a square tweeter opening 2904 with a corrugated plastic tweeter horn 2906 adhesively attached to the interior surface of front panel 2902. A tweeter 2908 is mounted to the tweeter horn 2906. Front panel 2902 supports a speaker support panel 2910 which, in turn, supports speaker 2912 having a basket rim 2914 having multiple fastener openings 2916 (one of four labeled). Plastic acoustic enclosure 2900 has left and right narrow panels 2918 and 2928 extending from opposing side edges of front panel 2902, left and right wide panels 2922 and 2926 extending from side edges of left and right narrow panels 2918 and 2928, respectively, and a narrow back panel 2924 extending between rear side edges of left and right wide panels 2922 and 2926. Top panel 2920 attaches to panels 2902, 2918, 2922, 2924, 2926 and 2928, as will be discussed in greater detail below.

Figure 30A:
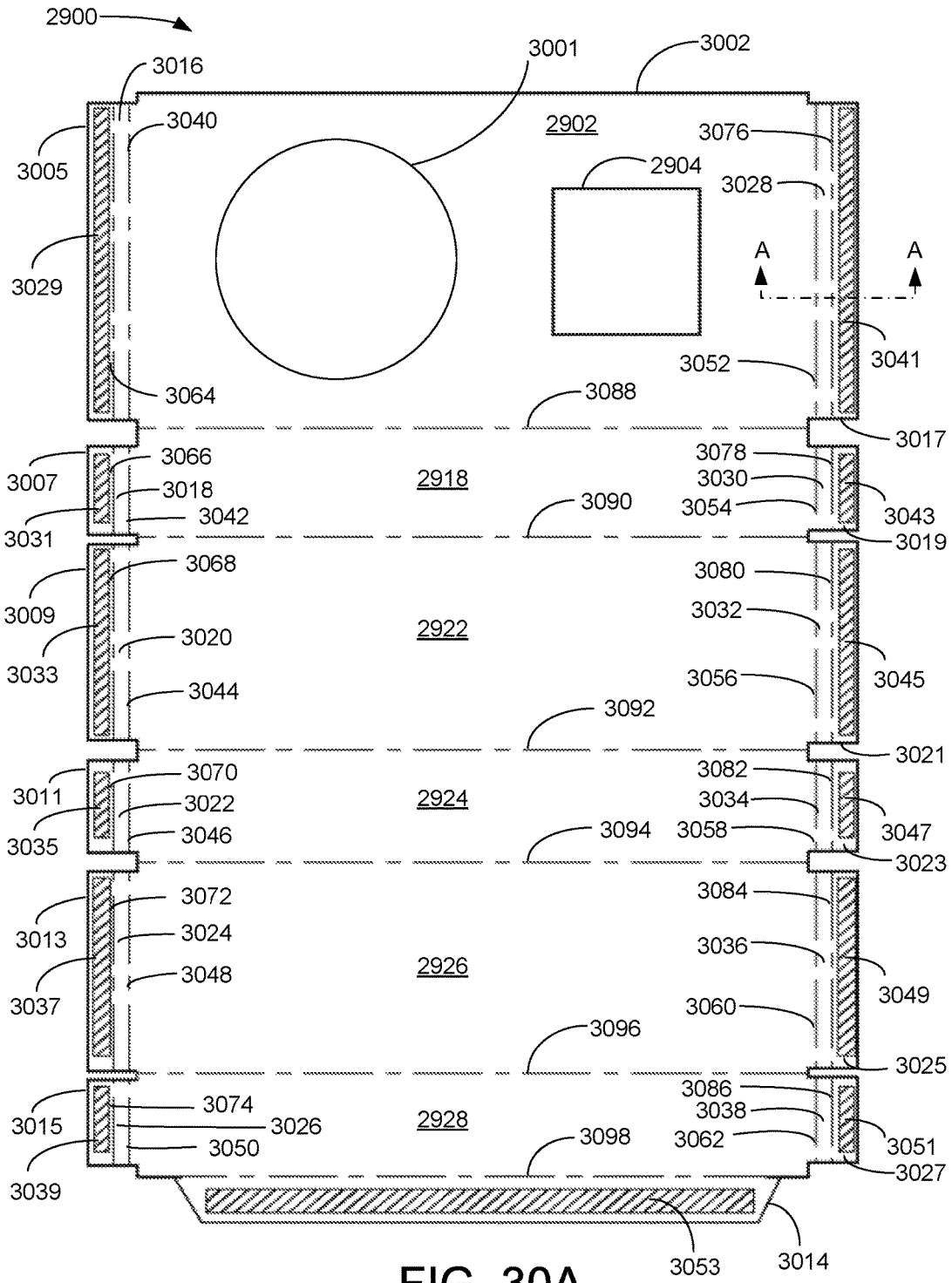
FIG. 30A is an interior side plan view illustrating the fourth exemplary embodiment of the plastic acoustic enclosure of FIG. 29 and defining cross section AA, according to a preferred embodiment of the present invention.

FIG. 30A is an interior side plan view illustrating the fourth exemplary embodiment of the plastic acoustic enclosure 2900 of FIG. 29 and defining cross section AA, according to a preferred embodiment of the present invention. A sheet 3002 of corrugated plastic has seven panels: 2902, 2918, 2922, 2944, 2926, 2928, and 3014 delineated by panel fold lines 3088, 3090, 3092, 3094, 3096, and 3098, respectively. Front panel 2902 has a speaker opening 3001 and a tweeter horn opening 2904, as shown. Front panel 2902 includes a top front panel double-folding adhesive flange 3017 having first and second parallel fold lines 3052 and 3076 with a top edge 3028 there between. Top front panel double-folding adhesive flange 3017 supports an adhesive strip 3041 having a release layer. Front panel 2902 includes a bottom front panel double-folding adhesive flange 3005 having first and second parallel fold lines 3040 and 3064 with a bottom edge 3016 there between. Bottom front panel double-folding adhesive flange 3005 supports an adhesive strip 3029 having a release layer.

Left side narrow panel 2918 is delineated from front panel 2902 by fold line 3088, which is similar to fold lines shown in detail in FIG. 1 and FIG. 14, which details are omitted here to simplify the drawing. Left side narrow panel 2918 includes a top left-side narrow panel double-folding adhesive flange 3019 having first and second parallel fold lines 3054 and 3078 with a top edge 3030 there between. Top left-side narrow panel double-folding adhesive flange 3019 supports an adhesive strip 3043 having a release layer. Left side narrow panel 2918 includes a bottom left side narrow panel double-folding adhesive flange 3007 having first and second parallel fold lines 3042 and 3066 with a bottom edge 3018 there between. Bottom left side narrow panel double-folding adhesive flange 3007 supports an adhesive strip 3031 having a release layer.

Left side wide panel 2922 is delineated from left side narrow panel 2918 by fold line 3090, which is similar to fold lines shown in detail in FIG. 1 and FIG. 14, which details are omitted here to simplify the drawing. Left side wide panel 2922 includes a top left-side wide panel double-folding adhesive flange 3021 having first and second parallel fold lines 3056 and 3080 with a top edge 3032 there between. Top left-side wide panel double-folding adhesive flange 3021 supports an adhesive strip 3045 having a release layer. Left side wide panel 2922 includes a bottom left-side wide panel double-folding adhesive flange 3009 having first and second parallel fold lines 3044 and 3068 with a top edge 3020 there between. Bottom left-side wide panel double-folding adhesive flange 3009 supports an adhesive strip 3033 having a release layer.

Narrow back panel 2924 is delineated from left side wide panel 2922 by fold line 3092, which is similar to fold lines shown in detail in FIG. 1 and FIG. 14, which details are omitted here to simplify the drawing. Narrow back panel 2924 includes a top narrow back panel double-folding adhesive flange 3023 having first and second parallel fold lines 3058 and 3082 with a top edge 3034 there between. Top narrow back panel double-folding adhesive flange 3023 supports an adhesive strip 3047 having a release layer. Narrow back panel 2924 includes a bottom narrow back panel double-folding adhesive flange 3011 having first and second parallel fold lines 3046 and 3070 with a bottom edge 3022 there between. Bottom narrow back panel double-folding adhesive flange 3011 supports an adhesive strip 3035 having a release layer.

Right side wide panel 2926 is delineated from narrow back panel 2924 by fold line 3094, which is similar to fold lines shown in detail in FIG. 1 and FIG. 14, which details are omitted here to simplify the drawing. Right side wide panel 2926 includes a top right-side wide panel double-folding adhesive flange 3025 having first and second parallel fold lines 3060 and 3084 with a top edge 3036 there between. Top right-side wide panel double-folding adhesive flange 3025 supports an adhesive strip 3049 having a release layer. Right side wide panel 2926 includes a bottom right-side wide panel double-folding adhesive flange 3013 having first and second parallel fold lines 3048 and 3072 with a top edge 3024 there between. Bottom right-side wide panel double-folding adhesive flange 3013 supports an adhesive strip 3037 having a release layer.

Right side narrow panel 2928 is delineated from right side wide panel 2926 by fold line 3096, which is similar to fold lines shown in detail in FIG. 1 and FIG. 14, which details are omitted here to simplify the drawing. Right side panel 2926 includes a top right side narrow panel double-folding adhesive flange 3027 having first and second parallel fold lines 3062 and 3086 with a top edge 3038 there between. Top right side wide panel double-folding adhesive flange 3027 supports an adhesive strip 3051 having a release layer. Right side panel 2928 includes a bottom right side narrow panel double-folding adhesive flange 3015 having first and second parallel fold lines 3050 and 3074 with a top edge 3026 there between. Bottom right side wide panel double-folding adhesive flange 3015 supports an adhesive strip 3039 with a release layer.

Adhesive panel 3014 is delineated from right side narrow panel 2928 by fold line 3098, which is similar to fold lines shown in detail in FIG. 1 and FIG. 14, which details are omitted here to simplify the drawing. Adhesive panel 3014 supports adhesive strip 3053 having a release layer for securing the folding panels 2902, 2918, 2922, 2924, 2926, 2928, and 3014 in an assembled configuration.

Figure 30B:
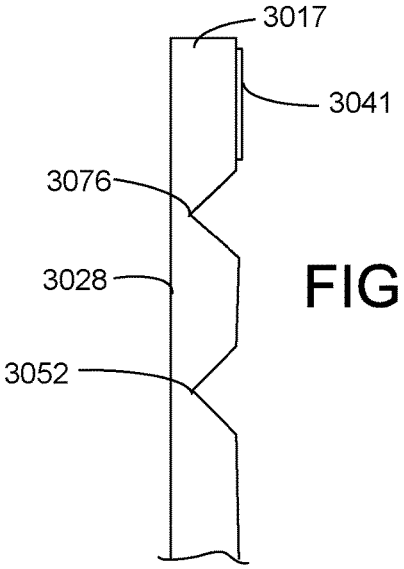
FIG. 30B is a cross sectional view through cross section AA of FIG. 30A illustrating an exemplary top front adhesive panel as a detail of the fourth exemplary embodiment of the plastic acoustic enclosure of FIG. 29, according to a preferred embodiment of the present invention.

FIG. 30B is a cross sectional view through cross section AA of FIG. 30A illustrating an exemplary top front panel adhesive panel 3017 illustrating a detail of the fourth exemplary embodiment of the plastic acoustic enclosure 2900 of FIG. 29, according to a preferred embodiment of the present invention. First and second fold lines 3052 and 3076 are centerlines of V-shaped grooves that enable folding to a predetermined angle, as shown.

Figure 30C:
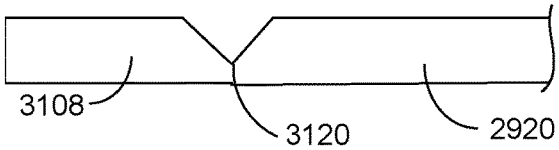
FIG. 30C is a cross sectional view through cross section BB of FIG. 31 illustrating an exemplary top panel as a detail of the fourth exemplary embodiment of the plastic acoustic enclosure of FIG. 29 and FIG. 31, according to a preferred embodiment of the present invention.
Figure 31:
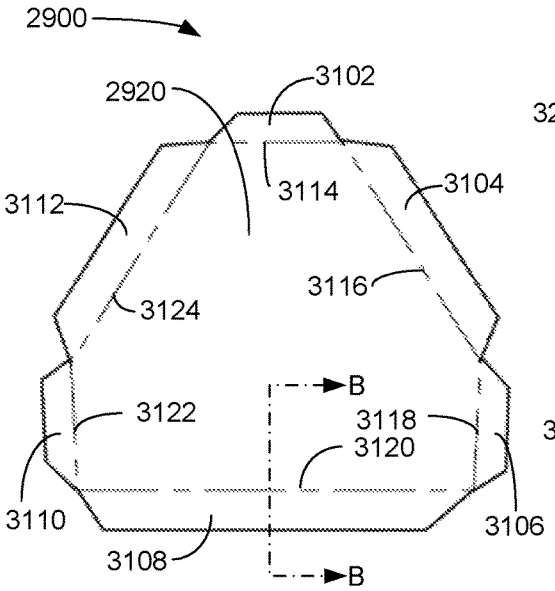
FIG. 31 is an outer side plan view illustrating an exemplary top panel of the fourth exemplary embodiment of the plastic acoustic enclosure of FIG. 29 and defining cross section BB, according to a preferred embodiment of the present invention.

FIG. 30C is a cross sectional view through cross section BB of FIG. 31 illustrating an exemplary top panel 2920 as a detail of the fourth exemplary embodiment of the plastic acoustic enclosure 2900 of FIG. 29 and FIG. 31, according to a preferred embodiment of the present invention. Fold line 3120 is a centerline of a V-shaped groove that enables folding to a predetermined angle, as shown.

Figure 30D:
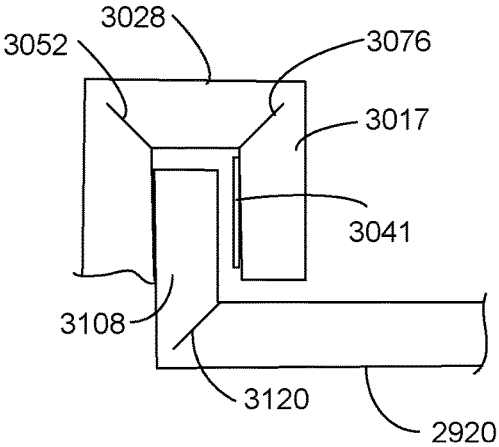
FIG. 30D is a cross sectional view illustrating an exemplary top front adhesive panel and top panel illustrating as details of the fourth exemplary embodiment of the plastic acoustic enclosure of FIG. 29 and FIG. 31, according to a preferred embodiment of the present invention.

FIG. 30D is a cross sectional view through cross section AA of FIG. 30A and cross section BB of FIG. 31 illustrating an exemplary top front adhesive panel 3017 and top panel 2920 illustrating a detail of the fourth exemplary embodiment of the plastic acoustic enclosure 2900 of FIG. 29 and FIG. 31, according to a preferred embodiment of the present invention. Top front panel adhesive panel 3017 has been folded at both fold lines 3052 and 3076 and the release strip has been removed from adhesive strip 3041. Top panel front flange 3108 has been folded at fold line 3120 and partially inserted into the bend of folded top front panel adhesive panel 3017 in an intermediate step of assembly.

Figure 30E:
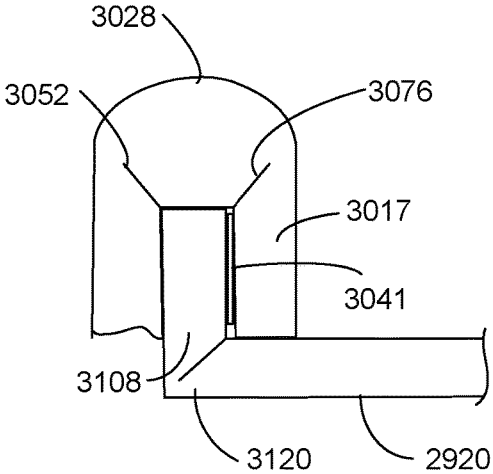
FIG. 30E is a cross sectional view illustrating an exemplary top front adhesive panel and top panel as details of the fourth exemplary embodiment of the plastic acoustic enclosure of FIG. 29 and FIG. 31, according to a preferred embodiment of the present invention.

FIG. 30E is a cross sectional view through cross section AA of FIG. 30A and cross section BB of FIG. 31 illustrating an exemplary top front adhesive panel 3017 and top panel 2920 as a detail of the fourth exemplary embodiment of the plastic acoustic enclosure 2900 of FIG. 29 and FIG. 31, according to a preferred embodiment of the present invention. Top panel front flange 3108 has been fully inserted in the bend of folded top front panel adhesive panel 3017 and the bend has been compressed in a final step of assembly. Compression causes top edge 3028 to bulge into a rounded edge. This adhesive coupling is exemplary of connections for all of the top panel flanges 3102, 3104, 3106, 3108, and 3110, as well as all bottom panel flanges 3204, 3206, 3208, 3210, 3212, and 3214 (see FIG. 31 and FIG. 32).

FIG. 31 is an outer side plan view illustrating an exemplary top panel 2920 of the fourth exemplary embodiment of the plastic acoustic enclosure 2900 of FIG. 29 and defining cross section BB, according to a preferred embodiment of the present invention. Top panel front flange 3108 is delineated from top panel 2920 by fold line 3120, which is similar to fold lines shown in detail in FIG. 1 and FIG. 14, which details are omitted here to simplify the drawing. Left narrow panel flange 3110 is delineated from top panel 2920 by fold line 3122. Left wide panel flange 3112 is delineated from top panel 2920 by fold line 3124. Narrow back panel flange 3102 is delineated from top panel 2920 by fold line 3114. Right wide panel flange 3104 is delineated from top panel 2920 by fold line 3116. Right narrow panel flange 3106 is delineated from top panel 2920 by fold line 3118. Folding along fold line 3120 is illustrated in FIGS. 30C-D, and is exemplary of fold lines generally.

Figure 32:
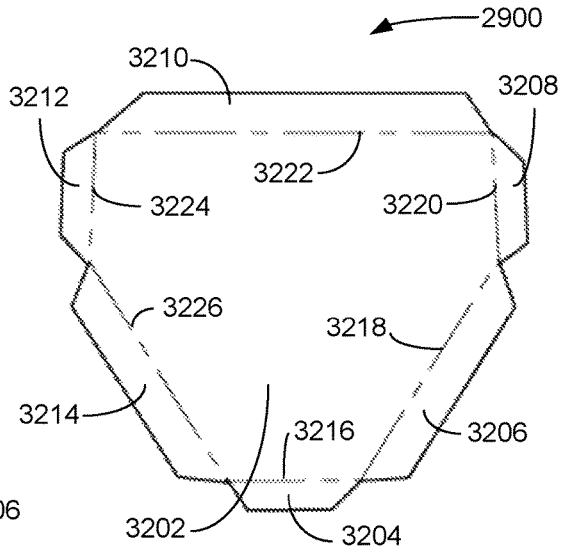
FIG. 32 is an outer side plan view illustrating an exemplary bottom panel of the fourth exemplary embodiment of the plastic acoustic enclosure of FIG. 29, according to a preferred embodiment of the present invention.

FIG. 32 is an outer side plan view illustrating an exemplary bottom panel 3202 of the fourth exemplary embodiment of the plastic acoustic enclosure 2900 of FIG. 29, according to a preferred embodiment of the present invention. Bottom panel 3202 is a mirror image of top panel 2920, and is used to close off the bottom end of the plastic acoustic enclosure 2900. Bottom panel front flange 3210 is delineated from bottom panel 3202 by fold line 3222, which is similar to fold lines shown in detail in FIG. 1 and FIG. 14, which details are omitted here to simplify the drawing. Left narrow panel flange 3208 is delineated from bottom panel 3202 by fold line 3220. Left wide panel flange 3206 is delineated from bottom panel 3202 by fold line 3218. Narrow back panel flange 3204 is delineated from bottom panel 3202 by fold line 3216. Right wide panel flange 3214 is delineated from bottom panel 3202 by fold line 3226. Right narrow panel flange 3212 is delineated from bottom panel 3202 by fold line 3224. All flanges 3102, 3104, 3106, 3108 3110, 3112, and 3204, 3206, 3208, 3210, 3212, and 3214 couple to respective side panels 2924, 2926, 2928, 2902, 2918, and 2922, respectively, in the same way as illustrated in FIG. 30E and as discussed above.

Figure 33:
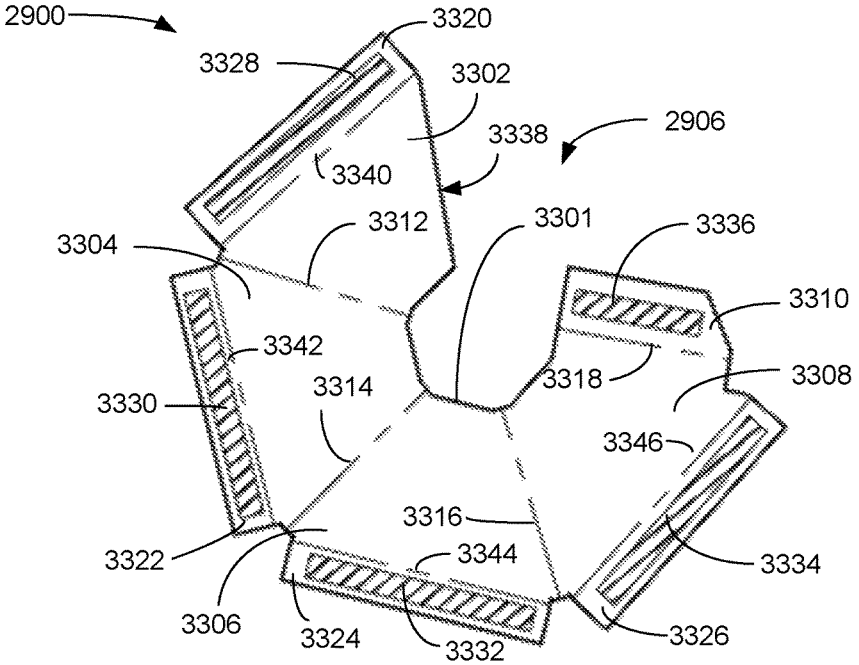
FIG. 33 is an interior plan view illustrating an exemplary tweeter horn of the fourth exemplary embodiment of the plastic acoustic enclosure of FIG. 29, according to a preferred embodiment of the present invention.

FIG. 33 is an interior plan view illustrating an exemplary tweeter horn 2906 of the fourth exemplary embodiment of the plastic acoustic enclosure 2900 of FIG. 29, according to a preferred embodiment of the present invention. Tweeter horn 2906 is a shaped sheet 3301 of corrugated plastic that includes trapezoidal corrugated plastic panels 3302, 3304, 3306 and 3308, as well as adhesive corrugated plastic folding panel 3310, which may be folded to secure the four trapezoidal panels 3302, 3304, 3306 and 3308 into a tweeter horn 2906 configuration (a truncated pyramidal shell). First trapezoidal panel 3302 has an adhesive foldable flange 3320 delineated from panel 3302 by folding line 3340 which is similar to fold lines shown in detail in FIG. 1 and FIG. 14, which details are omitted here to simplify the drawing. Adhesive foldable flange 3320 supports an adhesive strip 3328 having a release layer. First trapezoidal panel 3302 has a free edge 3338 which, during assembly, will be aligned to folding line 3318. First trapezoidal panel 3302 is delineated from second trapezoidal panel 3304 by folding line 3312. Second trapezoidal panel 3304 has an adhesive foldable flange 3322 delineated from panel 3304 by folding line 3342. Adhesive foldable flange 3322 supports an adhesive strip 3330 having a release layer. Second trapezoidal panel 3304 is delineated from third trapezoidal panel 3306 by folding line 3314. Third trapezoidal panel 3306 has an adhesive foldable flange 3324 delineated from panel 3306 by folding line 3344. Adhesive foldable flange 3324 supports an adhesive strip 3332 having a release layer. Third trapezoidal panel 3306 is delineated from fourth trapezoidal panel 3308 by folding line 3316. Fourth trapezoidal panel 3308 has an adhesive foldable flange 3326 delineated from panel 3308 by folding line 3346. Adhesive foldable flange 3326 supports an adhesive strip 3334 having a release layer. Adhesive corrugated plastic folding panel 3310 is delineated from fourth trapezoidal panel by folding line 3318. Adhesive corrugated plastic folding panel 3310 supports an adhesive strip 3336 having a release layer which, after assembly, will adhere to the rear surface of first trapezoidal panel 3302 (not visible in this view). Adhesive strips 3328, 3330, 3332, and 3334 adhere to the interior surface of front panel 2902 aligned near the sides of tweeter opening 2904 to fasten the tweeter horn 2906 to the front panel 2902, as shown in FIG. 29. Only adhesive strip 3336 is used to secure the tweeter horn 2906 in its operational configuration.

Figure 34:
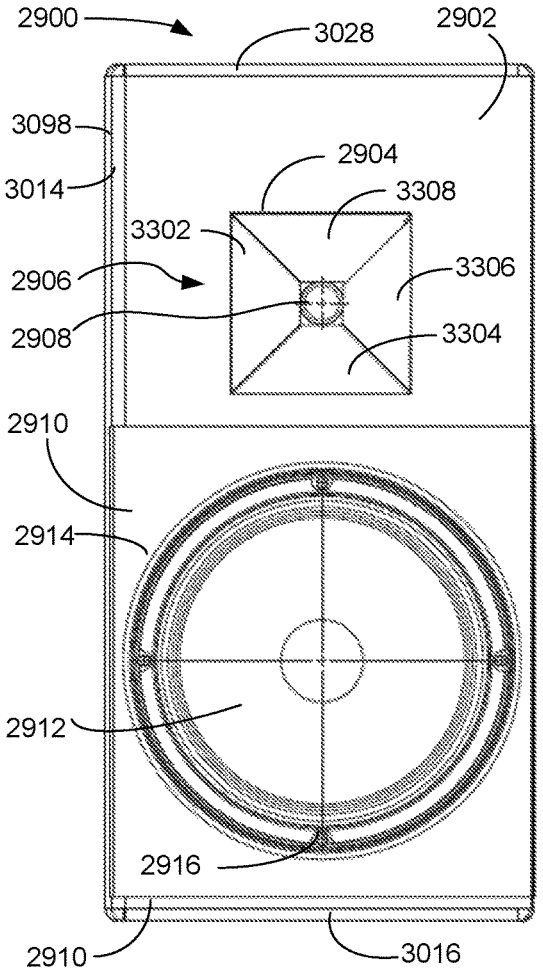
FIG. 34 is a front elevation view illustrating a variation the fourth exemplary embodiment of the plastic acoustic enclosure of FIG. 29, according to a preferred embodiment of the present invention.

FIG. 34 is a front elevation view illustrating a variation of the fourth exemplary embodiment of the plastic acoustic enclosure 2900 of FIG. 29, according to a preferred embodiment of the present invention. In this variation, the left, right and rear panels extend from the right side of the front panel 2902, rather than from the left side as shown in FIG. 30A, remembering that FIG. 30A is of the interior surfaces. As a result, adhesive panel 3014 wraps around the left side of front panel 2902 and fold line 3098 can be seen. Both approaches are with the scope of the present invention.

Figure 35:
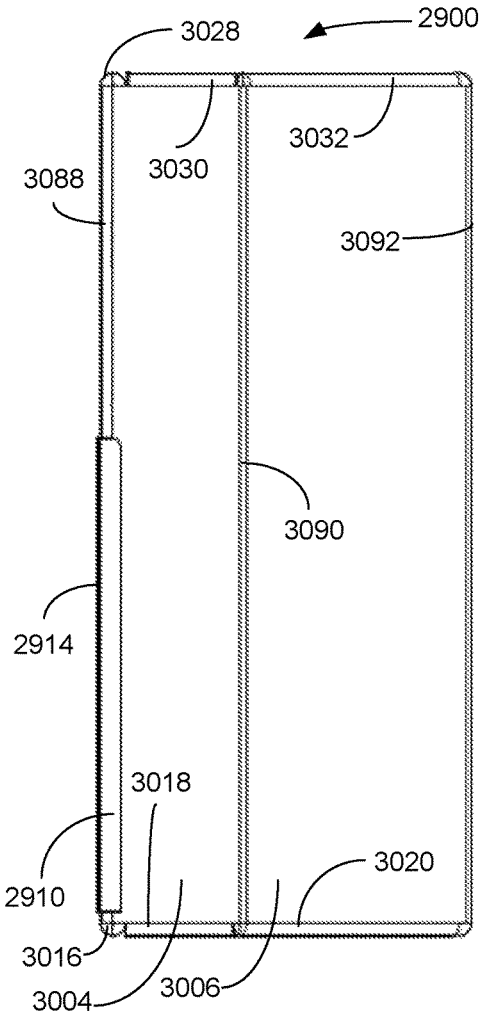
FIG. 35 is a side elevation view illustrating the fourth exemplary embodiment of the plastic acoustic enclosure of FIG. 29, according to a preferred embodiment of the present invention.

FIG. 35 is a right side elevation view illustrating the fourth exemplary embodiment of the plastic acoustic enclosure 2900 of FIG. 29 in the variation of FIG. 34, according to a preferred embodiment of the present invention. In various embodiments, various numbers and widths of sides may be used, consistent with acoustical quality and the design constraints of using corrugated foldable plastic sheets, folded and secured adhesively, and adapted to support a speaker.

Figure 36:
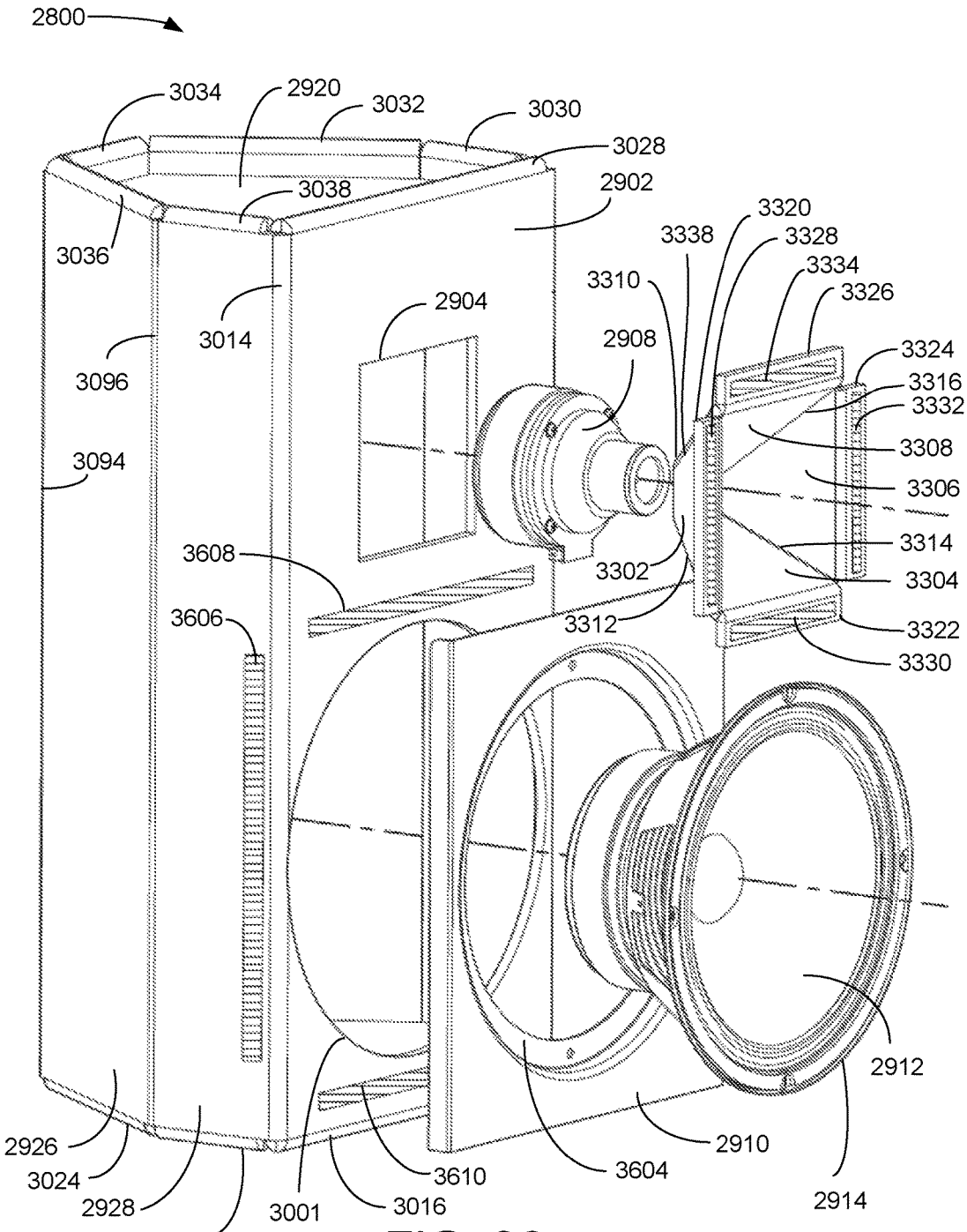
FIG. 36 is a front-side perspective exploded view illustrating the fourth exemplary embodiment of the plastic acoustic enclosure of FIG. 29, according to a preferred embodiment of the present invention.

FIG. 36 is a front-side perspective exploded view illustrating the fourth exemplary embodiment of the plastic acoustic enclosure 2900 of FIG. 29 in the variation of FIG. 34, according to a preferred embodiment of the present invention. Adhesive strips 3606, 3608, and 3610 are arranged around speaker opening 3001 to secure speaker support panel 2910 to front panel 2902 and left and right narrow panels 2928 and 2918, respectively. An additional adhesive strip, not visible in this view, is on right side narrow panel 2918 to assist in securing the speaker support panel 2910 to right side narrow panel 2918. Speaker support panel 2910 has a counter sunk annular flange 3604, to which the speaker basket rim 2914 directly fastens. In various embodiments, various numbers, shapes, and sizes of speakers may be supported in one plastic acoustic enclosure 2900.

The invention claimed is:

1. A plastic acoustic enclosure, comprising:
a. a sheet of corrugated plastic;
b. a plurality of fold lines in said sheet of corrugated plastic;
c. a speaker support ring adapted to assist in supporting a speaker at least partially within said at least one speaker support opening in said plastic acoustic enclosure;
d. wherein each said fold line of said plurality of fold lines comprises a centerline of a V-shaped groove in said sheet of corrugated plastic; and
e. at least one of:
i. at least one speaker opening in said sheet of corrugated plastic; and at least one speaker support opening in said sheet of corrugated plastic.

2. The plastic acoustic enclosure of claim 1, comprising at least one additional panel of corrugated plastic adapted to become part of said plastic acoustic enclosure upon assembly.

3. The plastic acoustic enclosure of claim 2, comprising a centerline of a V-shaped groove in said at least one additional panel of corrugated plastic.

4. The plastic acoustic enclosure of claim 2, comprising an audio amplifier attached to one of:
a. said sheet of corrugated plastic; and
b. a panel of said at least one additional panel of corrugated plastic.

5. The plastic acoustic enclosure of claim 2, comprising at least one adhesive foldable flange extending from said at least one additional panel of corrugated plastic.

6. The plastic acoustic enclosure of claim 1, comprising at least one adhesive strip adapted to secure said sheet of corrugated plastic in a folded configuration.

7. The plastic acoustic enclosure of claim 1, comprising acoustic dampening material applied to one of:
c. said V-shaped groove;
d. a portion of said sheet of corrugated plastic; and
e. a channel in said sheet of corrugated plastic.

8. The plastic acoustic enclosure of claim 1, comprising at least one speaker support adapted to assist in supporting a speaker at least partially within said at least one speaker support opening in said plastic acoustic enclosure.

9. The plastic acoustic enclosure of claim 8, comprising a rim on said at least one speaker support, wherein at least a portion of said rim is configured to rest on an environmental surface when said plastic acoustic enclosure is assembled and placed in an operational orientation.

10. The plastic acoustic enclosure of claim 8, comprising a plurality of adhesive strips adapted to adhere said speaker support to said sheet of corrugated plastic.

11. The plastic acoustic enclosure of claim 1, comprising:
a. two corrugated plastic side panels; and
b. a speaker support adapted to assist in supporting a speaker at least partially within said at least one speaker support opening in said plastic acoustic enclosure.

12. The plastic acoustic enclosure of claim 1, comprising:
a. a corrugated plastic interior support; and
b. a speaker support ring adapted to assist in supporting a speaker at least partially within said at least one speaker support opening in said plastic acoustic enclosure.

13. The plastic acoustic enclosure of claim 1, comprising:
a. a corrugated plastic shaped sheet configurable to form a tweeter horn; and
b. a speaker support panel having a counter sunk annular flange.

14. A plastic acoustic enclosure, comprising:
a. a sheet of corrugated plastic;
b. a plurality of fold lines in said sheet of corrugated plastic;
c. at least one of:
i. at least one speaker opening in said sheet of corrugated plastic; and
ii. at least one speaker support opening in said sheet of corrugated plastic;
d. at least one additional panel of corrugated plastic adapted to become part of said plastic acoustic enclosure upon assembly; and
e. wherein at least one said fold line of said plurality of fold lines comprises a centerline of a V-shaped groove in said at least one additional panel of corrugated plastic; and
f. wherein each said fold line of said plurality of fold lines comprises a centerline of a V-shaped groove in said sheet of corrugated plastic.

15. The plastic acoustic enclosure of claim 14, comprising at least one adhesive foldable flange extending from said at least one additional panel of corrugated plastic.

16. The plastic acoustic enclosure of claim 14, comprising:
a. at least one speaker support adapted to assist in supporting a speaker at least partially within said plastic acoustic enclosure;
b. a rim on said at least one speaker support, wherein at least a portion of said rim is configured to rest on an environmental surface when said plastic acoustic enclosure is assembled and placed in an operational orientation; and
c. a plurality of adhesive strips adapted to adhere said speaker support to said sheet of corrugated plastic.

17. The plastic acoustic enclosure of claim 14, acoustic dampening material applied to one of:
a. said V-shaped groove;
b. a portion of said sheet of corrugated plastic; and
c. a channel in said sheet of corrugated plastic.

18. The plastic acoustic enclosure of claim 14, comprising an audio amplifier attached to one of:
a. said sheet of corrugated plastic; and
b. a panel of said at least one additional panel of corrugated plastic.

19. A plastic acoustic enclosure, comprising:
a. a sheet of corrugated plastic;

b. a plurality of fold lines in said sheet of corrugated plastic;

c. top and bottom panels, each said panel having three adhesive foldable flanges, each adhesive foldable flange of said three adhesive foldable flanges extending from one of three edges of said panel, respectively;

d. a speaker support ring adapted to assist in supporting a speaker at least partially within said at least one speaker support opening in said plastic acoustic enclosure;

e. at least one of:

i. at least one speaker opening in said sheet of corrugated plastic; and ii. at least one speaker support opening in said sheet of corrugated plastic;

f. further comprising at least one of:

iii. at least one corrugated plastic side panel adapted to form a part of said plastic acoustic enclosure, when assembled;

iv. a speaker support ring adapted to form a part of said plastic acoustic enclosure, when assembled;

v. a speaker support panel adapted to form a part of said plastic acoustic enclosure, when assembled;

vi. a speaker support fixture adapted to form a part of said plastic acoustic enclosure, when assembled;

vii. a corrugated plastic interior support adapted to form a part of said plastic acoustic enclosure, when assembled;

viii. said top and bottom panels of said sheet of corrugated plastic, each said panel having three adhesive foldable flanges of said at least one adhesive flange, each said adhesive foldable flange of said three adhesive foldable flanges extending from one of three edges of said at least one edge of said panel, respectively;

ix. an audio amplifier attached to one of;

1) a corrugated plastic panel of said at least one corrugated plastic side panel; and 2) said corrugated plastic sheet; and x. acoustic dampening material applied to one of:

1) said V-shaped groove;

2) a portion of said sheet of corrugated plastic; and 3) a channel in said sheet of corrugated plastic; and xi. attachment features on said sheet of corrugated plastic, comprising at least one of:

1) channels;

2) adhesive strips;

3) adhesive strips with release layers;

4) channels with adhesive strips;

5) channels with adhesive strips with release layers;

6) adhesive sound deadening materials;

7) adhesive sound deadening materials with release layers;

8) channels with adhesive sound deadening materials; and 9) channels with adhesive sound deadening materials with release layers.

* * * * *